US005951416A

United States Patent [19]

Allen et al.

[11] Patent Number: 5,951,416

[45] Date of Patent: Sep. 14, 1999

[54] BREAKAWAY NET ATTACHMENT SYSTEM

[75] Inventors: David A. Allen, Oconomowoc; Ronald A. White, N. Prairie, both of Wis.; James N. Fitzsimmons, Aurora, Ohio; Joseph K. Bohrman, Eagle; Randy R. Schickert, Kewaskum, both of Wis.

[73] Assignee: Huffy Corporation, Miamisburg, Ohio

[21] Appl. No.: 08/874,732

[22] Filed: Jun. 13, 1997

Related U.S. Application Data

[63] Continuation-in-part of application No. 08/640,127, Apr. 30, 1996, Pat. No. 5,792,010, which is a continuation-in-part of application No. 08/275,954, Jul. 15, 1994, Pat. No. 5,524, 883.

[51] Int. Cl.[6] ..... A63B 63/08

[52] U.S. Cl. ..... 473/489

[58] Field of Search ..... 473/472, 479, 473/485, 486, 487, 488, 489

[56] References Cited

U.S. PATENT DOCUMENTS

| | | |
|---|---|---|
| D. 238,284 | 12/1975 | Toedter . |
| 1,491,286 | 4/1924 | Calhoun . |
| 1,585,840 | 5/1926 | Fahnstock . |
| 1,764,950 | 6/1930 | Griner . |
| 2,199,609 | 5/1940 | Bennett . |
| 2,489,174 | 11/1949 | Cunningham . |
| 2,579,312 | 12/1951 | Garvey . |
| 2,884,249 | 4/1959 | Cunningham . |
| 3,194,555 | 7/1965 | Humphrey . |
| 3,348,272 | 10/1967 | Germani . |
| 3,582,032 | 6/1971 | Placek . |
| 4,082,269 | 4/1978 | Hill . |
| 4,241,916 | 12/1980 | Palm . |
| 4,353,548 | 10/1982 | Mahoney . |
| 4,834,368 | 5/1989 | Qualley . |
| 4,903,964 | 2/1990 | Anderson . |
| 4,905,995 | 3/1990 | Apo . |
| 4,917,340 | 4/1990 | Juemann et al. . |
| 4,932,626 | 6/1990 | Guillot . |
| 5,098,091 | 3/1992 | McGivern . |
| 5,123,642 | 6/1992 | Stokes . |
| 5,301,939 | 4/1994 | Ellsworth . |
| 5,338,023 | 8/1994 | Stovall . |
| 5,360,208 | 11/1994 | Fang . |
| 5,381,588 | 1/1995 | Nelson . |
| 5,795,253 | 8/1998 | Allen ..... 473/589 |

FOREIGN PATENT DOCUMENTS

| | | |
|---|---|---|
| 0329893 | 8/1989 | European Pat. Off. . |
| 1214739 | 12/1970 | United Kingdom . |
| 1338325 | 11/1973 | United Kingdom . |
| 1553077 | 9/1979 | United Kingdom . |

OTHER PUBLICATIONS

Huffy Sports Parts List and Assembly Instruction Sheet, Oct. 5, 1993, and sample net clip.

Brochure, "OBO stud welding/The better solution," OBO Bettermann (Bettermann of America, Inc., Pittsburgh, PA), 11 pages.

Murray, C.J. (ed.), "Plastic Net Clips Make Basketball Safer," *Design News*, May 8, 1995, p. 73.

EPO Search Report EP 95 30 4948, Nov. 7, 1995.

*Primary Examiner*—William H. Grieb

*Attorney, Agent, or Firm*—Howrey & Simon; Michael J. Bell; Andrew R. Kopsidas

[57] ABSTRACT

A breakaway net attachment system for detachably mounting a basketball net to the rim of a basketball goal with resilient net clips. The net clips include a base portion attachable to the rim and a retainer portion for detachably retaining the net in association with the rim. The rim preferably includes a plurality of studs or apertures located along an undersurface thereof for engaging within apertures or projections provided on the clips, whereby the clips are retained in engagement with the rim. In some embodiments, the clips are provided with flexible fingers for retaining the net wherein the fingers will release the net in response to a predetermined force being applied to the net. In further embodiments, the clips are adapted to be pulled off of the rim when a predetermined force is applied to the net.

51 Claims, 24 Drawing Sheets

BREAKAWAY NET ATTACHMENT SYSTEM

This application is a continuation-in-part of application Ser. No. 08/640,127, filed Apr. 30, 1996, now U.S. Pat. No. 5,792,010, which is a continuation-in-part of application Ser. No. 08/275,954, filed Jul. 15, 1994, now U.S. Pat. No. 5,524,883.

BACKGROUND OF THE INVENTION

The invention relates to a system for detachably retaining a net on a basketball goal rim and, more particularly, to a system for detachably retaining a net on a basketball goal rim whereby the net may be detached from the rim upon application of a predetermined force.

Basketball goal nets are typically retained on the rim of a goal by attaching looped end portions of the net to hooked portions welded to the rim of the goal. By passing the looped portions of the net over the welded rams on the rim, the net is substantially rigidly or non-detachably retained on the rim during use of the goal, for example during a game of basketball.

Under certain circumstances it is desirable to permit the net to detach from the rim of the goal whereby a force in excess of that applied during normal play will not be conveyed through or resisted by the connection point between the net and the rim. In other words, in many instances it is desirable for the net to be capable of separating from the rim, such as when a player engages and produces a pulling force on the net, while also ensuring that the net remains engaged with the rim during the normal course of play.

In one known net attachment system, plastic ties are used to wrap around the rim and looped end portions of the net whereby the net is retained on the rim of the goal. The ends of each of the plastic ties are connected to each other and will separate from each other when a large force is applied to the net, thereby permitting the net to separate from the rim of the goal. However, such a system does not position the attachment points for the net at predetermined locations such that a uniform positioning of the attachment points along the rim is not assured. Further, when the net becomes detached from the rim the connecting ties will be freed from both the net and the rim such that they may be lost, thereby hindering reattachment of the net to the rim.

Accordingly, there is a need for a basketball goal net attachment system whereby the net may be attached to predetermined locations along the rim of a basketball goal, and which further ensures that the components of the attachment system remain associated with the system during detachment of the net from the rim. There is also a need to make such a breakaway net attachment system simple for a consumer to use and easy to manufacture.

SUMMARY OF THE INVENTION

In one aspect of the invention, a system is provided for holding a net on a basketball goal rim wherein the system generally includes a clip which is attachable to the rim, the clip including a retainer portion for retaining a portion of the net on the rim. In addition, the clip is formed with a release mechanism for releasing the net from the rim in response to the application of a predetermined force on the net. In one aspect of the invention, the retainer portion comprises elongated finger members for retaining the member on the clip. The finger members may be in the form of hook shaped elements located along alternating sides of the clip in facing relationship to each other whereby the net is retained in the clip. Alternatively, the retainer portion may comprise opposing finger members wherein one finger member includes a hook end and the opposing finger member includes a detent end for engaging the hook end whereby a passage is defined for retaining the net in engagement with the clip.

Upon application of a predetermined force, the finger members will flex and separate to permit the portion of the net engaged within the passage formed between the fingers to pass out of the passage, resulting in separation of the net from the rim.

In a further aspect of the invention, the rim is provided with studs rigidly attached at regular intervals along a lower portion of the rim. The studs include an enlarged head portion for engaging within an aperture formed in a base portion of the clip. The aperture may be in the form of either an elongated slot for sliding the clip into place on the stud, or in the form of a circular aperture configured to permit the clip to be pushed toward the rim causing the head of the stud to pass through the aperture.

The base of the clip is generally designed to ensure that the clip remains engaged with the rim during separation of the net from the above-described finger members. In this manner, reattachment of the net to the rim is facilitated in that the clip is retained with the system.

In a further embodiment of the invention, the retainer portion of the system comprises means defining an aperture for receiving a doubled-over looped portion of the net. The net is retained on the clip by causing the doubled-over looped end of the net to pass through the aperture and extend around the clip. In addition, the clip includes an aperture for receiving a stud rigidly mounted to the rim of the basketball goal wherein the stud includes an enlarged head. The means defining the aperture for receiving the stud is sufficiently resilient to permit the aperture to expand for permitting the clip to disengage from the rim upon application of a predetermined force. The clip is designed to remain engaged with the net such that the net may be readily reattached to the rim.

In above described embodiments of the invention, the clips are detachably connected to rim by the engagement of an aperture formed in the clip with a stud rigidly attached to the rim. According to another aspect of the invention, the clips may be detachably connected to the rim by the engagement of a projection extending from the clip with an aperture in the rim, which is preferably formed as a hollow goal ring with the apertures being punched or otherwise formed therein. This type of a clip attachment facilitates the use of detachment systems where the clip remains on the rim when releasing the net and where the clip and net together separate from the rim to detach the net from the rim. It also permits the use of net clips and rims that are particularly simple to make and use.

Therefore, it is an object of the invention to provide a net retention system for a basketball goal whereby the net is detachably retained on the rim of the goal.

It is a further object of the invention to provide such a net retention system including a clip for retaining a portion of the net on the rim.

It is yet a further object of the invention to provide such a system wherein the clip is attachable to the rim of a basketball goal and wherein the net is disengageable from the clip in response to a predetermined force applied to the net.

It is another object of the invention to provide a net retention system including a clip wherein the clip is detachable from the rim of a basketball goal upon application of a predetermined force.

It is yet another object of the invention to provide a net retention system that is easy to manufacture and simple for a consumer to use.

Other objects and advantages of the invention will be apparent from the following description, the accompanying drawings and the appended claims.

BRIEF DESCRIPTION OF THE DRAWINGS

FIG. 29 is a schematic perspective view of an eighth embodiment of the invention showing a bottom portion of a hollow rim having an aperture adapted to be resiliently engaged by a projection of a net clip having deformable fingers for retaining and releasing a net similar to the first five embodiments;

FIG. 30 is a simplified, cross sectional view showing the clip of FIG. 29 engaged within the aperture in the rim;

FIG. 31 is a schematic perspective view of a ninth embodiment of the invention showing a bottom portion of a hollow rim having an aperture for receiving a projection of a net clip adapted to be resiliently engaged within the aperture in which the clip receives and retains a doubled-over looped portion of a net similar to the sixth and seventh embodiments;

FIG. 32 is a simplified, cross sectional view showing the clip of FIG. 31 engaged within the aperture in the rim;

FIGS. 33-34 are schematic perspective and cross sectional views, respectively, of a tenth embodiment of the invention that operates similarly to the ninth embodiment shown in FIGS. 31-32;

FIGS. 35-36 are schematic perspective and cross sectional views, respectively, of an eleventh embodiment of the invention that is similar to the tenth embodiment, but requires rotation of the clip to attach it to the rim;

FIGS. 37-38 are schematic perspective and cross sectional views, respectively, of a twelfth embodiment of the invention in which the clip has scissor-type ends adapted to resiliently engaged within a slot-shaped aperture in the rim;

FIGS. 39-40 and 41-42 are schematic perspective and cross sectional views of thirteenth and fourteenth embodiments of the invention, respectively, having scissor-type ends similar to the twelfth embodiment shown in FIGS. 37-38;

FIGS. 43-44 are schematic perspective and cross sectional views, respectively, of a fifteenth embodiment of the invention in which the clip is formed as a small rod-like member adapted to be resiliently engaged within a slot-shaped aperture in the rim;

FIGS. 45-46 are schematic perspective and cross sectional views, respectively, of a sixteenth embodiment of the invention which is a particularly easy to manufacture and use as the clip is formed simply from a twisted, resilient member;

FIGS. 47-48 are schematic perspective and cross sectional views, respectively, of a seventeenth embodiment of the invention in which each clip has two ends that are resiliently engaged in separate apertures in the rim; and FIGS. 49–53 are simplified, cross sectional views of rims of the invention showing examples of the type of shapes and forms that may be used.

DETAILED DESCRIPTION OF THE PREFERRED EMBODIMENTS

Figure 1:
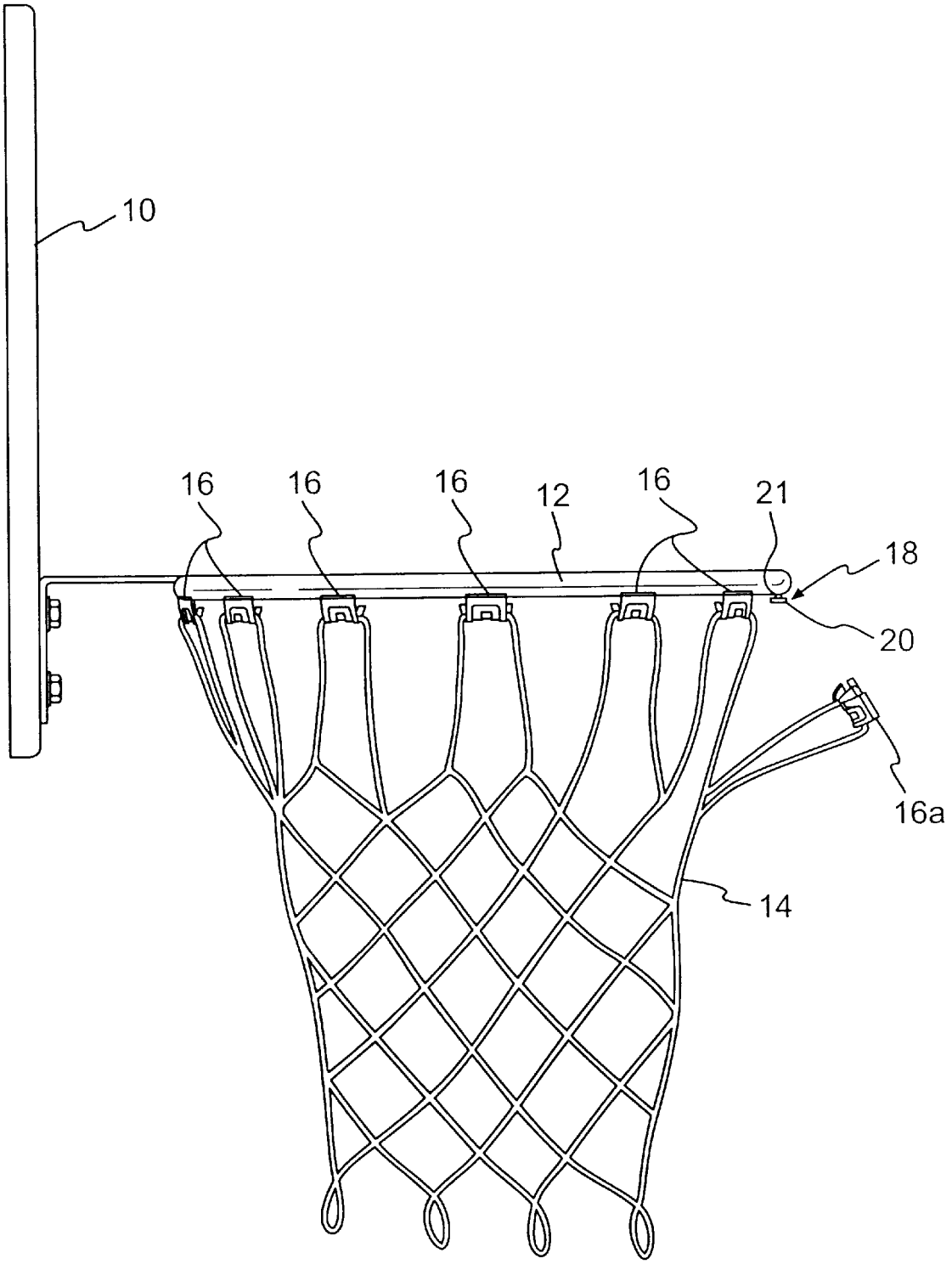
FIG. 1 is a side elevational view of a basketball goal incorporating the net retention system of the invention.

Referring to FIG. 1, the net retention system of the invention is intended to be used with a conventional basketball goal system including a backboard 10 supporting a rim 12. A net 14 is attached to the rim by a plurality of clips 16, each of the clips 16 holding a looped mounting portion of the net 14. One of the clips 16*a* is shown detached from the rim 12 to reveal a mounting portion for the clip in the form of a stud 18 wherein the stud includes a shaft portion 21 and an enlarged head 20 and is rigidly mounted to the rim 12 through a welded connection or the like. One particularly advantageous way of connecting the studs to the rim is the drawn arc stud welding process described in commonly assigned, copending application Ser. No. 08/594,519 of David A. Allen, entitled Basketball Goal Rim for Breakaway Net Attachment System and Method of Making Same, the disclosure of which is incorporated by reference herein. Of course, other suitable methods may be employed for rigidly connecting the studs to the rim as will be readily appreciated by those skilled in the art. Twelve of the studs 18 are located along the lower edge of the rim 12 in substantially uniformly spaced relation to each other whereby a plurality of predetermined mounting locations for the clips 16 are defined.

Referring to FIGS. 2–5, the clip 16 includes a base portion 22 and a retainer portion defined by a plurality of elongated finger members 24, 26, 28, 30 wherein the finger members 24, 30 extend from a side portion 32 of the base portion 22 and the finger members 26, 28 extend from an opposing side portion 34 of the base portion 22. Further, the finger members 26, 28 are connected to each other through a bridge portion 36.

It should be noted that the finger members 24, 26, 28, 30 are formed as hooked shaped members defining a passage 38 through the clip 16 in spaced relation to the rim 12 for receiving a portion of the net 14 wherein the net 14 may be positioned within the passage 38 by threading it over the ends of the finger members 24, 26, 28, 30.

Figure 2:
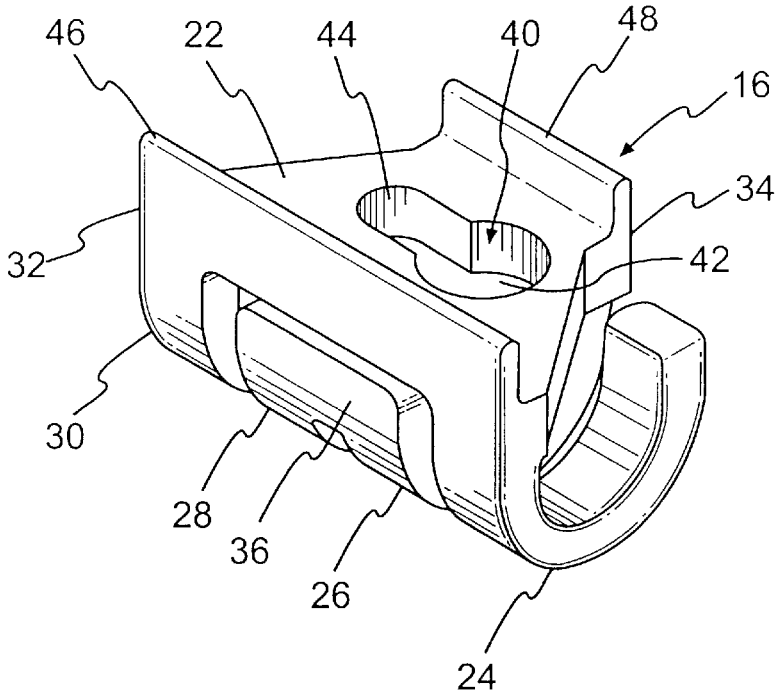
FIG. 2 is a perspective view of a clip for use in the system of the invention.
Figure 3:
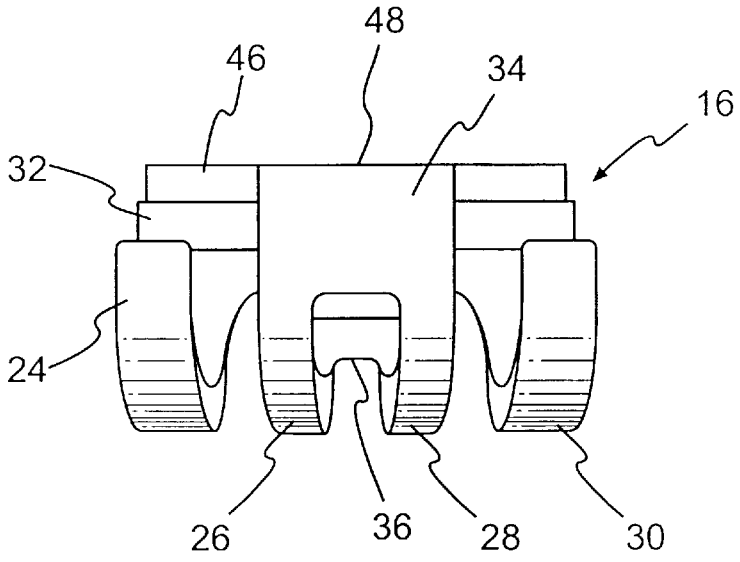
FIG. 3 is a side elevational view of the clip of FIG. 2.
Figure 4:
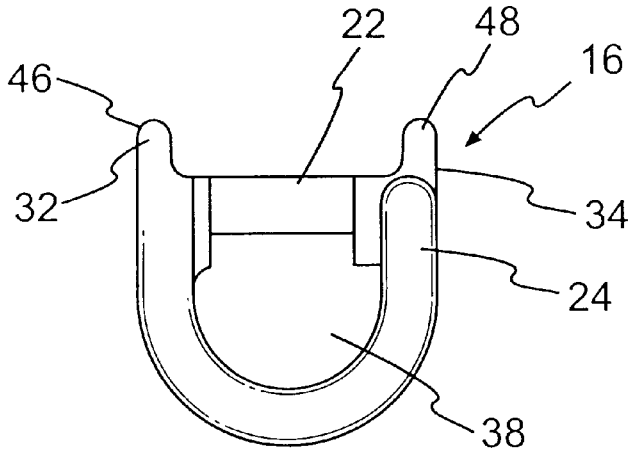
FIG. 4 is an end view of the clip of FIG. 2.
Figure 5:
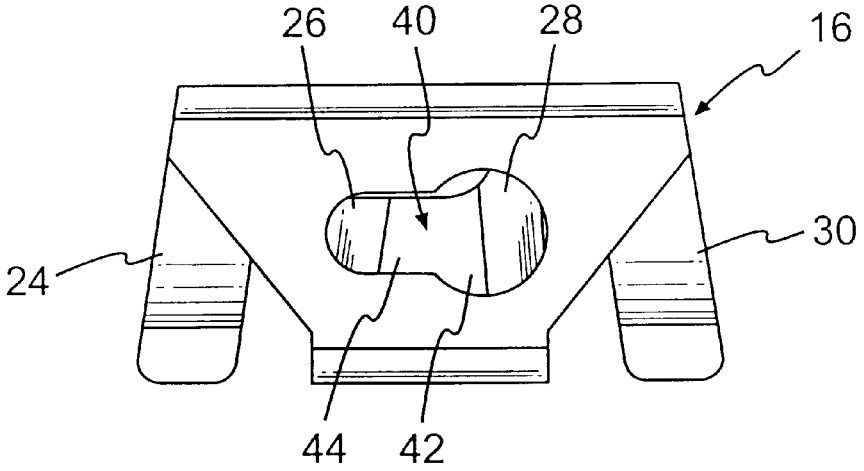
FIG. 5 is a top plan view of the clip of FIG. 2.

As seen in FIGS. 2 and 5, an engaging portion for engaging the stud 18 is defined on the base portion 22 and comprises means defining an aperture 40 through the base portion 22. The aperture 40 is in the form of a keyhole slot having an enlarged portion 42 and a neck portion 44. The enlarged portion 42 is sized to receive the enlarged head 20 of the stud 18 and the neck portion 44 is sized smaller than the head 20 of the stud 18 and is adapted to receive the shaft portion 21. Thus, the clip 16 will be held rigidly in place on the rim 12 when the stud 18 is positioned within the aperture 40 and is slid into alignment with the neck portion 44 of the aperture 40.

Figure 6:
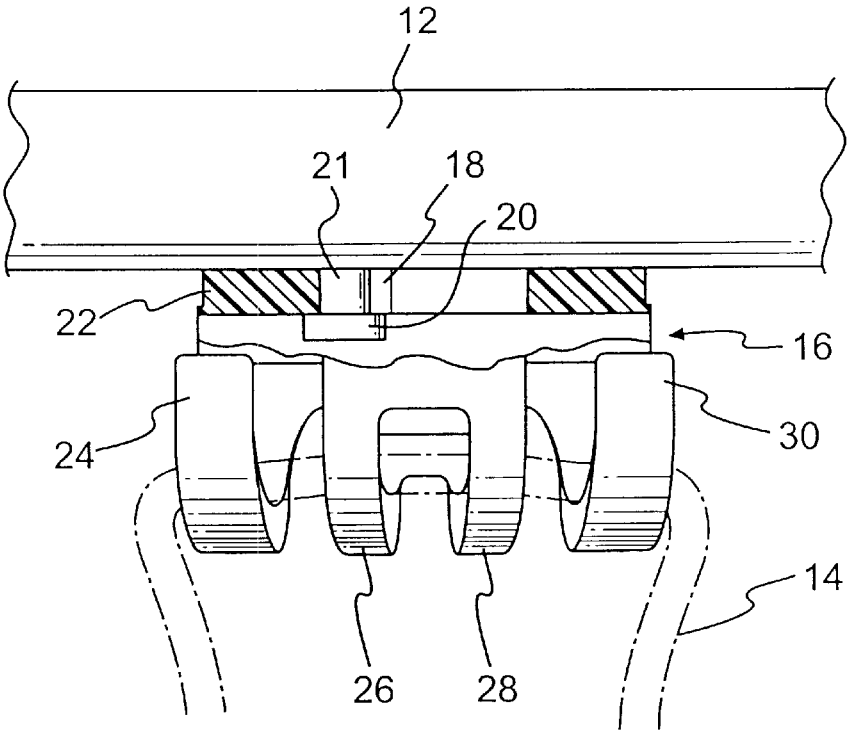
FIG. 6 is a partially cut away view showing the clip of FIG. 2 mounted to the rim of a basketball goal.
Figure 7:
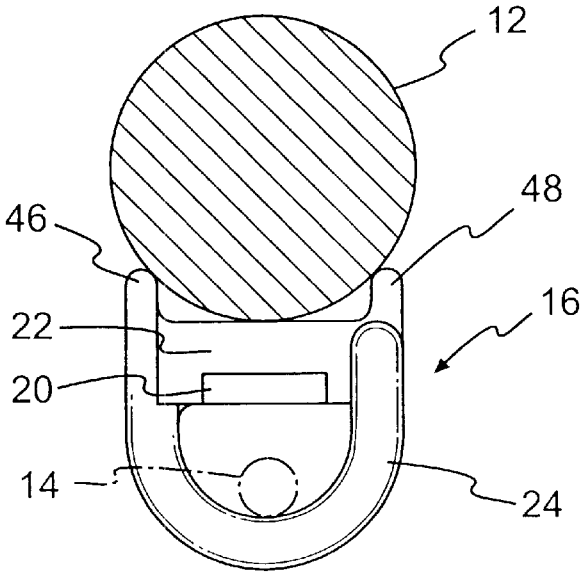
FIG. 7 is an end view of the clip of FIG. 2 mounted to the rim of a basketball goal.
Figure 8:
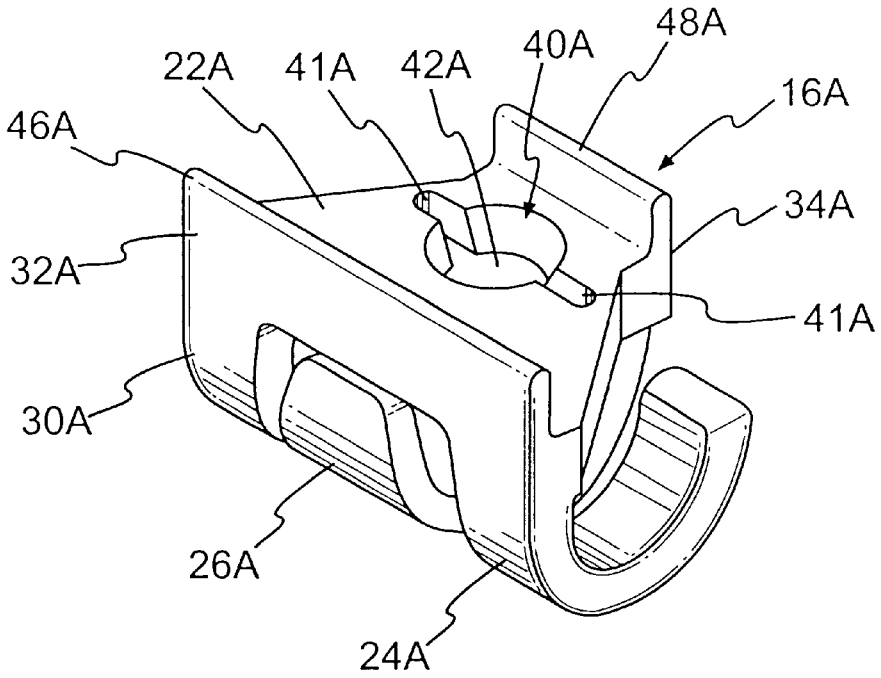
FIG. 8 is a perspective view of a second embodiment of the clip.
Figure 9:
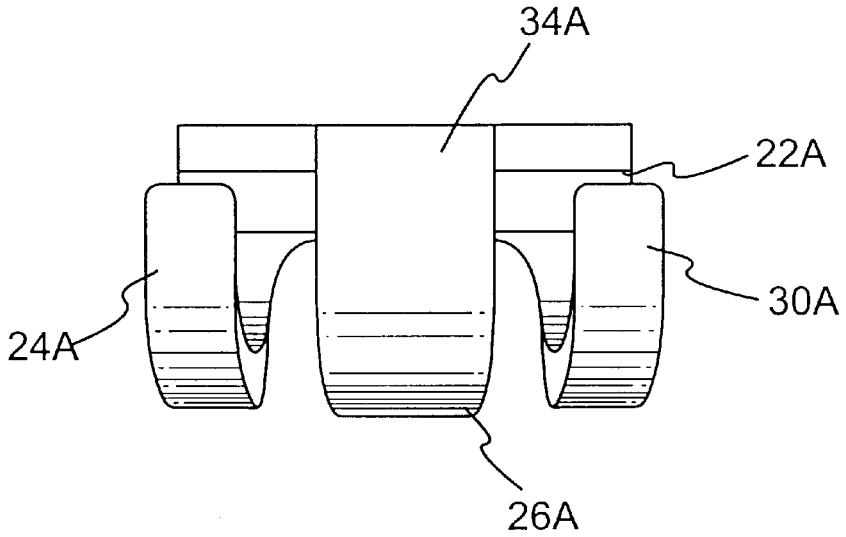
FIG. 9 is a side elevational view of the clip of FIG. 8.

Referring to FIGS. 6 and 7, the clip 16 is shown mounted to a portion of the rim 12 wherein a portion of the net 14 passes through the passage 38 defined by the finger members 24, 26, 28, 30. It should be noted that the opposing side portions 32 and 34 of the base portion 22 include upwardly extending legs 46 and 48, respectively, for engaging the rim 12 and thereby providing a stable base for the clip 16 preventing rocking and rotational movement of the clip relative to the rim 12.

In addition, it should be noted that the clip 16 is preferably formed of a resilient material, such as nylon or the equivalent, whereby the finger members further comprise a release mechanism for releasing the net 14 from the rim 12 in response to application of a predetermined force on the net 14. Specifically, the finger members are capable of moving or flexing downwardly and outwardly to permit the net 14 to pass out of the passage 38 when a predetermined force is applied on the net.

Further, as seen in FIG. 7, the clip 16 is configured such that it is smaller than the diameter of the rim 12. Thus, the clip 16 is substantially located below the rim 12 such that the top and side portions of the rim 12 are substantially unobstructed by the clip 16. The configuration for the clip 16 minimizes the possibility of a ball contacting the clip 16 during use of the net attachment system.

Referring to FIGS. 8–11, a second embodiment of the clip for the invention is illustrated and is identified as 16A. The clip 16A is substantially similar to the clip 16 of the first embodiment and includes a base portion 22A having opposing sides 32A, 34A. Three finger members 24A, 26A, 30A are provided extending in alternating manner from the opposing sides 32A and 34A to define a net receiving passage 38A. In addition, a pair of legs 46A and 48A extend upwardly on the base portion 22A for engagement with the rim 12.

Figure 10:
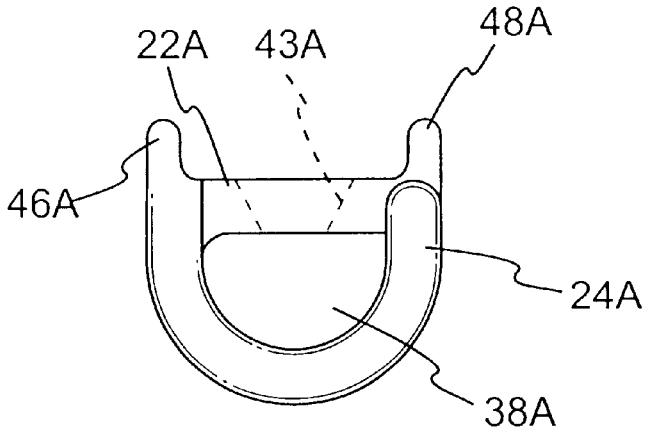
FIG. 10 is an end view of the clip of FIG. 8.
Figure 11:
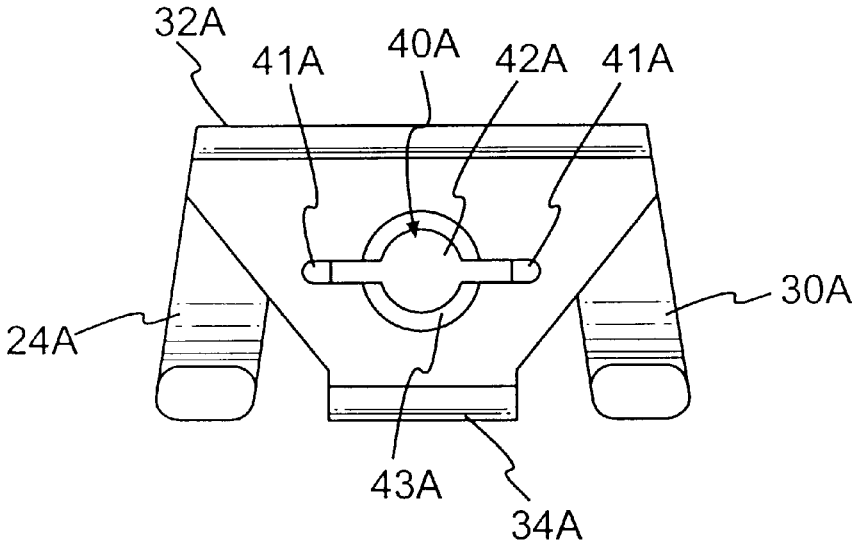
FIG. 11 is a top plan view of the clip of FIG. 8.

The clip 16A is provided with an aperture 40A including means defining a substantially circular opening 42A for receiving the stud 18. As seen in FIG. 10, the means defining the opening 42A includes sloped or tapered walls 43A to facilitate insertion of the head portion 20 of the stud 18 through the base portion 22A. In addition, narrow slotted areas 41A are provided extending radially from the open area 42A to further facilitate opening of the area 42A upon insertion of the clip past the head portion 20. Thus, the clip 16A is mounted to the rim 12 by moving the base portion 22A toward the rim 12, causing the stud 18 to pass through the aperture 40A. Further, although only two slots 41A are illustrated, it should be understood that any number of the slots 41A may be provided to facilitate mounting of the clip 16A to the rim 12.

The clip 16A operates in a manner similar to that described for the clip 16 of the first embodiment in that the finger members 24A, 26A, 30A will retain a portion of the net 14 on the rim 12 during the normal course of play, and are formed of a resilient material such that they will release the net in response to application of a predetermined force on the net 14. In addition, the area of engagement between the aperture 40A and the stud 18 is configured such that the clip 16A will be retained on the rim 12 during release of the net 14.

Figure 12:
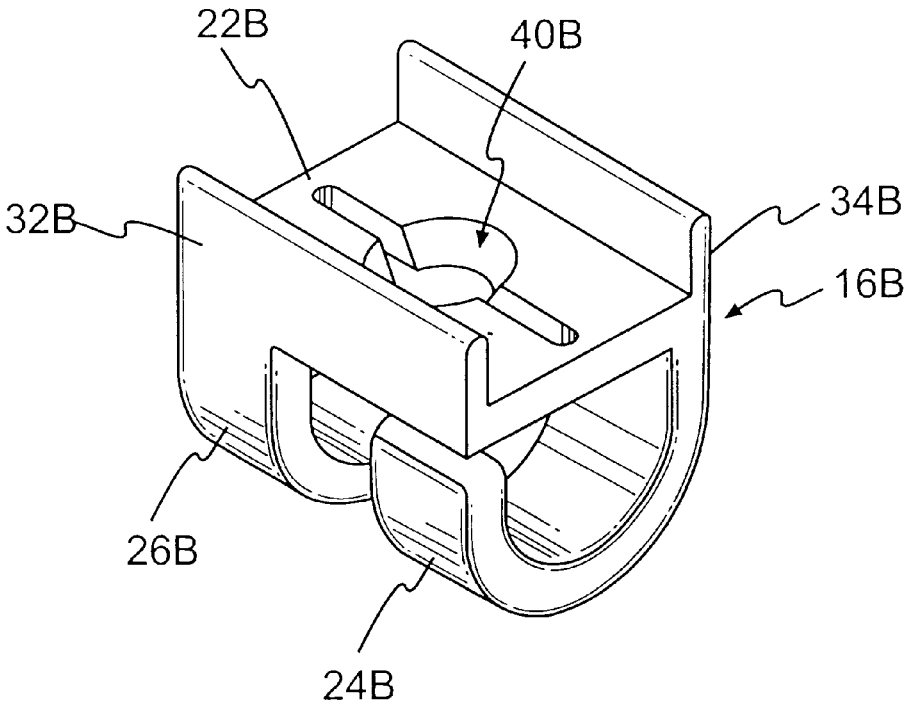
FIG. 12 is a perspective view of a third embodiment of the clip.

Referring to FIG. 12, a third embodiment of the clip is illustrated and designated as 16B. The clip 16B is substantially similar to the clip 16A of the second embodiment with the exception that only two finger members 24B, 26B are provided. The finger members 24B, 26B extend from alternate sides 32B, 34B of a base portion 22B. Further, an aperture 40B similar to aperture 40A is provided for engagement with a stud 20 on the rim 12.

It should be noted that by providing different numbers of finger members, as well as by varying the width or thickness of the finger members, the amount of force required to detach the net from the clip member may be selectively varied.

Figure 13:
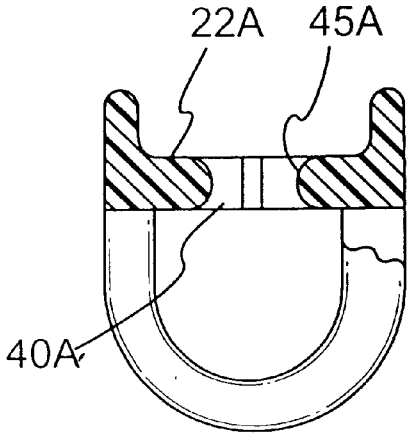
FIG. 13 is an end view of the clip of FIG. 9 partially cut away to show an alternative configuration for an aperture defining an engaging portion for a clip.

Referring to FIG. 13, an alternative configuration for the aperture 40A of the clip 16A is illustrated wherein the tapered walls 43A of the aperture 40A have been replaced with radiused walls 45A. By providing the radiused walls 45A, the clip 16A is provided with the capability of being pulled off of the stud 18 upon application of a predetermined force. In addition, the enlarged head portion 20 of the stud 18 may be designed with a taper in order to facilitate movement of the base portion 22A out of engagement with the stud 18. Thus, the clip 16A may be configured with a dual release mechanism in that, upon application of a predetermined force, either the net will separate from the finger members 24A, 26A, 30A, or the entire clip 16A will separate from the rim 12.

It should be noted that the radiused aperture illustrated in FIG. 13 may also be incorporated into the embodiment of the clip illustrated in FIG. 12 in order to provide the clip 16B with a dual release mechanism.

Figure 14:
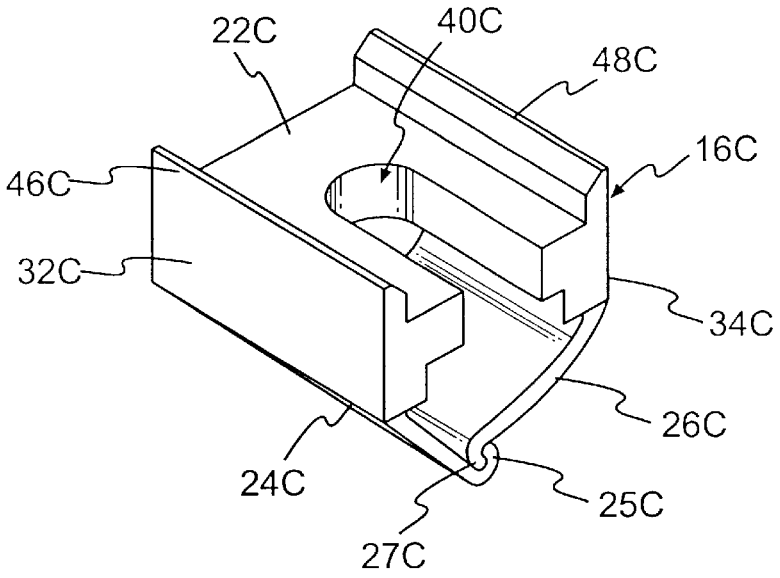
FIG. 14 is a perspective view of a fourth embodiment of the clip.
Figure 15:
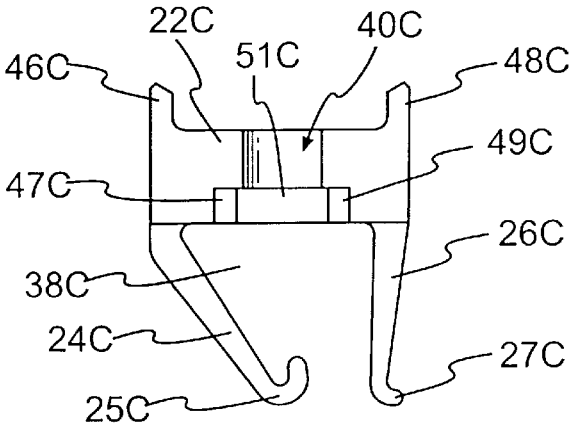
FIG. 15 is an end view of the clip of FIG. 14.
Figure 16:
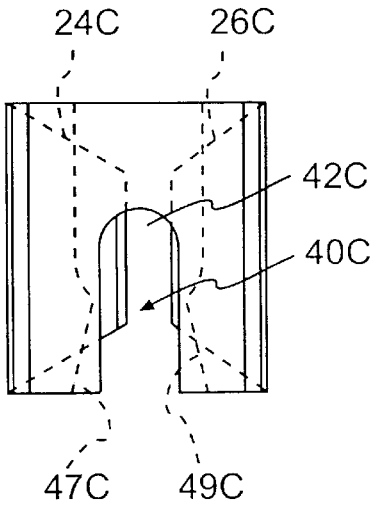
FIG. 16 is a top plan view of the clip of FIG. 14.
Figure 17:
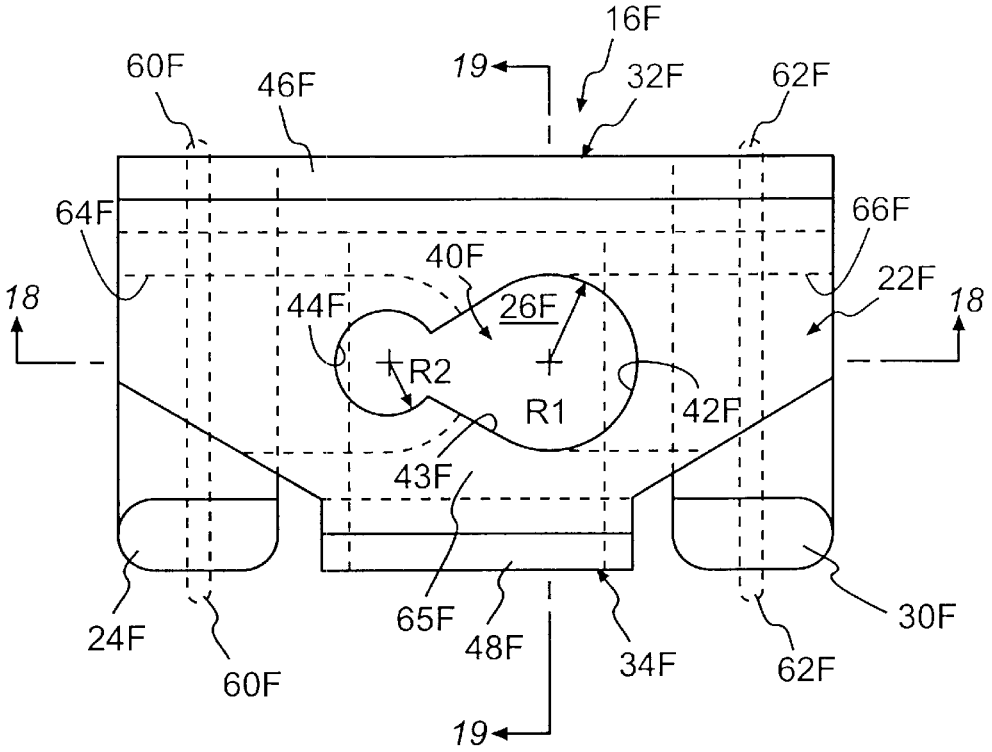
FIG. 17 is a top plan view of a fifth embodiment of the clip of the invention showing sections of the clip not visible from above in phantom.
Figure 18:
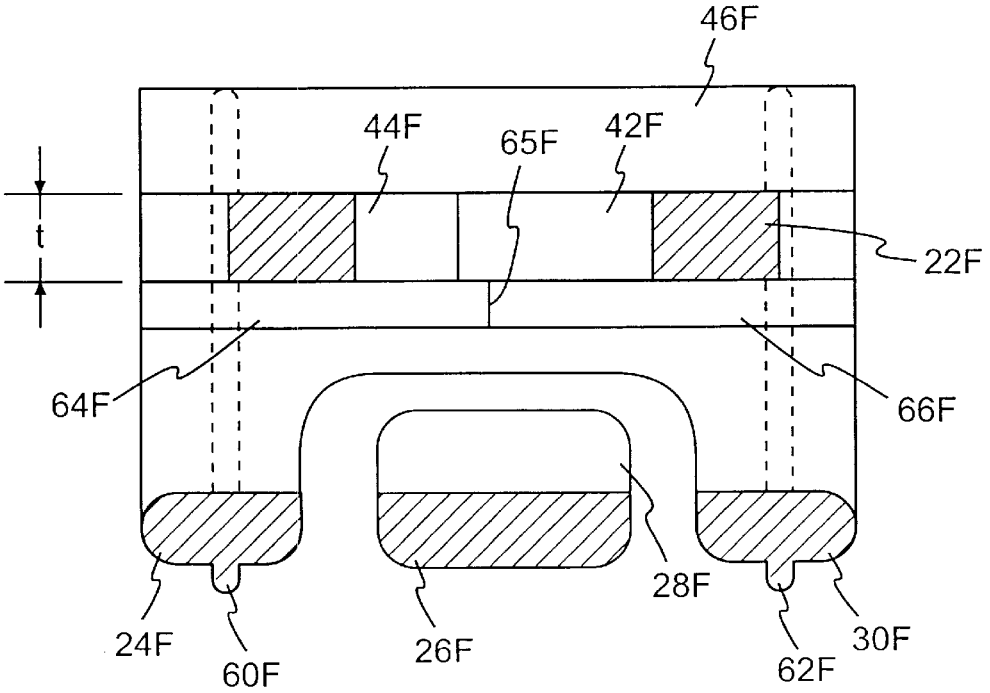
FIG. 18 is a longitudinal sectional view of the clip of FIG. 23 taken along lines 18—18 in FIG. 17.
Figure 19:
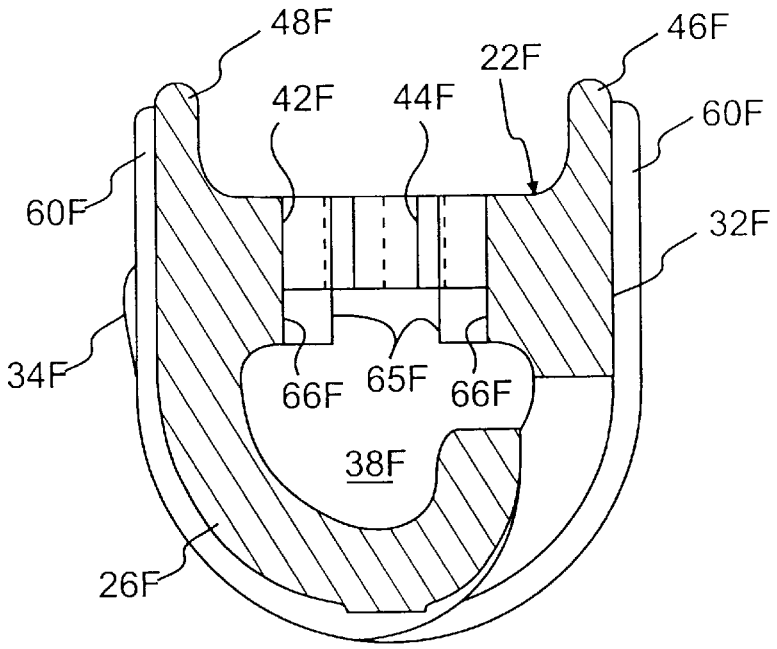
FIG. 19 is a transverse sectional view of the clip of FIG. 17 taken along lines 19—19 in FIG. 17.
Figure 20:
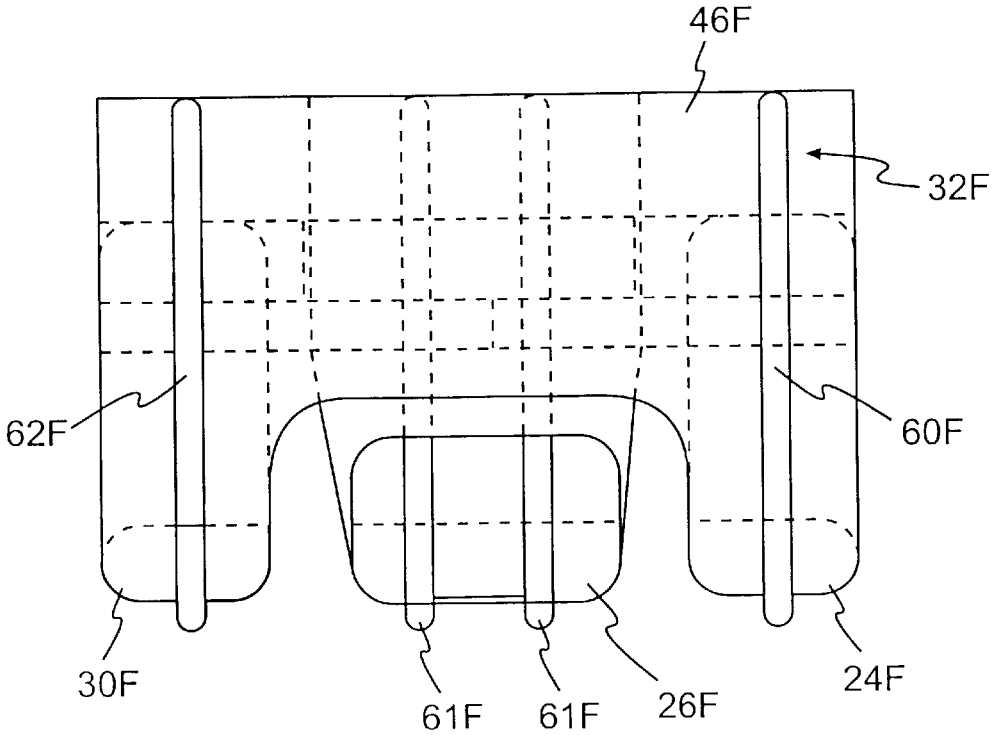
FIG. 20 is a side elevational view of one side of the clip of FIG. 17
Figure 21:
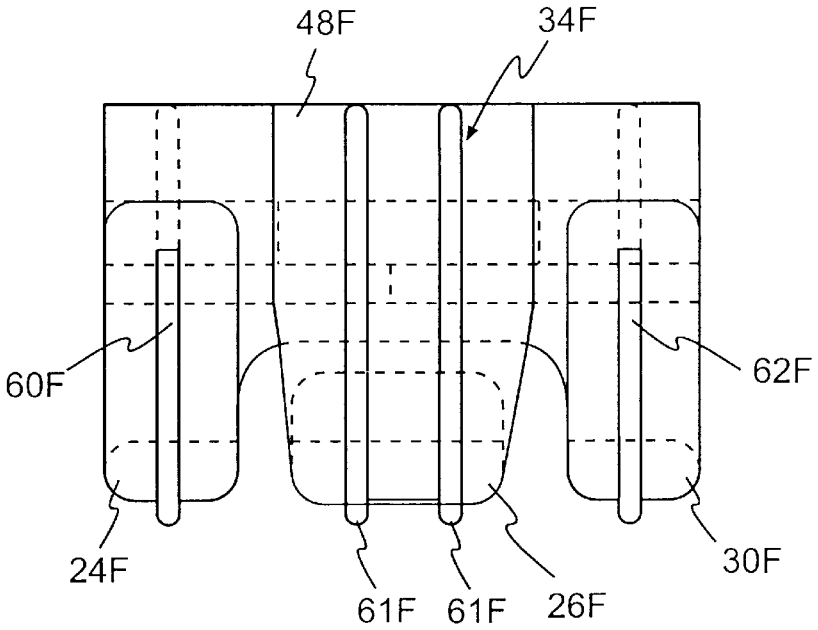
FIG. 21 is a side elevational view of the other side of the clip of FIG. 17.
Figure 22:
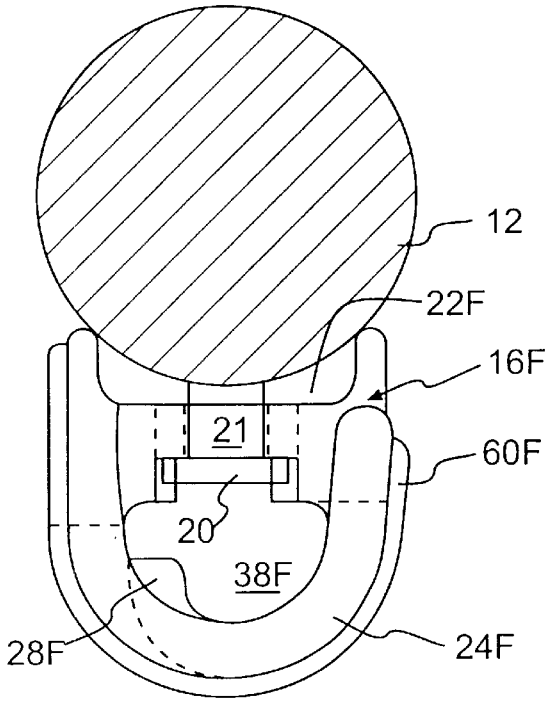
FIG. 22 is an end view of the clip of FIG. 17 mounted to the rim of a basketball goal.

Referring to FIGS. 14–16, a fourth embodiment of the clip is illustrated and is designated as 16C. The clip 16C includes a base portion 22C having opposing side portions 32C, 34C supporting opposing finger members 24C and 26C respectively. The finger member 24C includes a hook end 25C and the finger member 26C includes a detent end 27C for engaging with the hook end 25C. Referring to FIG. 15, the finger members 24C and 26C are shown in a position prior to retention of the net 14 in the clip 16C. After insertion of a portion of the net 14 into the area 38C, the finger member 26C is moved toward the finger member 24C whereby the detent end 27C engages with the hook end 25C, as shown in FIG. 14.

As seen in FIGS. 14 and 16, the base portion 22C is provided with an aperture 40C in the form of an elongated slot to receive the stud 18. The slot 40C includes a lower area 51C for cooperating with the sides of the head portion 20 of the stud 18. The lower area 51C includes walls 47C and 49C angling inwardly from an open mouth of the slot 40C, and the walls 47C, 49C, define a restricted end area 42C of the slot 40C whereby the head 20 is retained in position on the clip 16C. Thus, the clip 16C is mounted to the rim 12 by sliding the clip 16C along a stud 18 until the enlarged head 20 of the stud 18 is located adjacent to the area 42C.

In use, the clip 16C is rigidly retained on the rim 12 and supports a portion of the net 14 within the passage 38C defined between the interengaged finger members 24C and 26C. When a predetermined force is applied against the net, the finger members 24C and 26C will flex thereby causing the detent end 27C to disengage from the hook end 25C to release the net from the clip 16C.

Referring to FIGS. 17–22, a fifth embodiment of the clip is illustrated and is designated as 16F. The clip 16F is substantially similar to the clip 16A of the second embodiment shown in FIGS. 8–11, but includes an aperture 40F in the form of a keyhole-type slot more similar to slot 40 of the first embodiment than the circular aperture 40A provided in the second embodiment. The structure and function of clip 16F is substantially similar to the clips described in the first and second embodiments. The base portion 22F of clip 16F has opposing sides 32F and 34F, with outer fingers 24F and 30F extending downwardly from side 32F while inner finger 26F extends downwardly from opposite side 34F. Finger 26F is visible through the aperture 40F shown in FIG. 17 and includes a bulbous end portion 28F best shown in FIGS. 18 and 22, which helps retain the net in passage 38F.

One or more of the finger members 24F, 26F and 30F may be provided with a rib projecting outwardly from the outer surface of the finger member and extending along the length of the finger member. In the illustrated embodiment of FIGS. 17–22, outer finger members 24F and 30F are formed with ribs 60F, 62F, respectively, which extend from the top of one of the upstanding legs 46F and 48F, to the end of the respective finger member. Inner finger 26F is shown as having two spaced ribs 61F extending from near the top of upstanding leg 48F to the end of finger member 26F. The ribs 60F, 61F and 62F serve to increase the strength and rigidity of the individual finger members and are especially useful when forming the clip from a particularly resilient material. Of course, depending upon the desired release force and the material properties employed, the ribs may be eliminated in whole or in part.

Aperture 40F is similar to the keyhole slot aperture 40 described in connection with a first embodiment, but is formed from two, generally circular portions having different radii $r_1$ and $r_2$, and which are connected together by a substantially straight transition portion. In particular, the slot 40F has an enlarged portion 42F with a radius of curvature $r_1$ and a reduced portion 44F having a smaller radius of curvature $r_2$. The enlarged portion 42F has a cross-section somewhat larger than a semi-circle, while the reduced portion 44F with the smaller radius $r_2$ subtends an arc much greater than 180 degrees. The two circular portions 42F and 44F are connected by opposed, substantially straight portions 43F. As in the first embodiment of clip 16, the enlarged portion 42F is sized to receive the enlarged head 20 of the stud and the reduced portion 44F is sized smaller than the head 20 of the stud and is adapted to receive the shaft portion 21. In addition, the underside of base portion 22F is slotted or cutout at 64F and 66F beneath the aperture 40F, as shown best in FIGS. 17 and 18. Towards the middle of the slotted portions 64F and 66F, the sides of the slot extend inwardly at 65F at a position adjacent, but just outside the opening of reduced portion 44F. This narrowed portion 65F underneath the base helps retain the shaft portion 21 of the stud 18 within the reduced portion 44F. In addition, the thickness t of the base portion 22F has been increased slightly over that shown in the first embodiment to increase the force with which the clip is held onto the rim.

In one particularly advantageous and presently preferred embodiment of the invention, the clip 16F may be formed from a commercially available blend of ultraviolet radiation (U.V.) stabilized polypropylene sold by the M.A. Hanna company of Cleveland, Ohio under the trade name XP-5989 and having the following material properties:

Tensile Strength: 2400 psi

Elongation: 4%

Flexural Modulus: 105,000 psi

Notched IZOD: 12.5 ft.-lb./in.

Of course, other materials may be used instead of this particular blend of polypropylene and different properties may be designed for instead of the particular values enumerated above without departing from the principles of the invention, as will be readily apparent to the skilled artisan.

Figure 23:
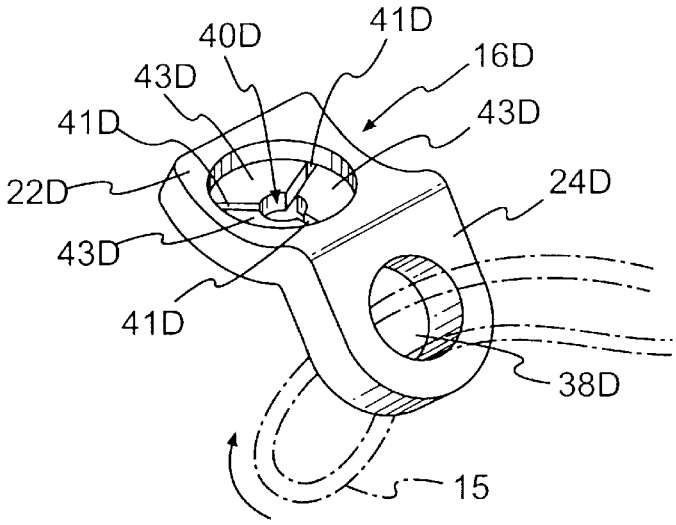
FIGS. 23–25 are perspective views of a sixth embodiment of the clip showing the steps of attaching a portion of the net to the clip.
Figure 24:
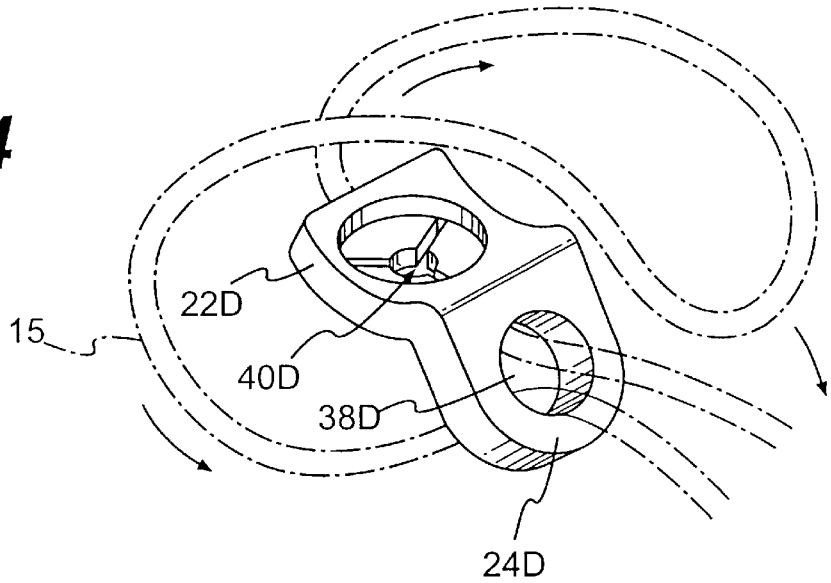
Figure 25:
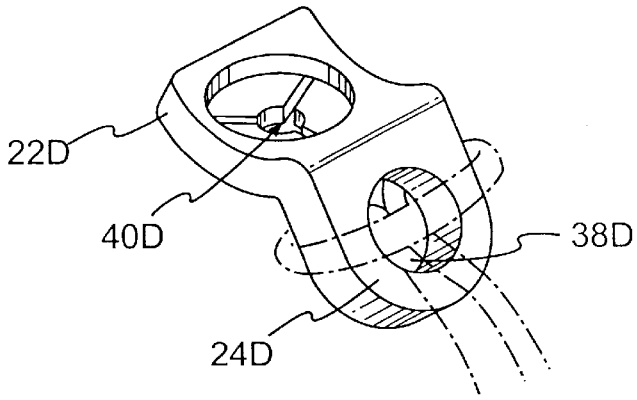

Referring to FIGS. 23–25, a sixth embodiment of the clip is illustrated and is designated 16D. The clip 16D includes a base portion 22D and retainer portion 24D. The base portion is curved to substantially match the curvature of the rim 12 and includes an engaging portion including means defining an aperture 40D and a plurality of slots 41D extending radially therefrom whereby a plurality of flexible tangs 43D are formed having end portions defining the aperture 40D. The tangs 43D flex to permit the base portion 22D to be readily attached to and detached from a stud 18 on the rim 12 upon application of a predetermined force.

The retainer portion 24D extends at an angle downwardly from the base portion 22D, and may extend substantially perpendicular to the base portion 22D. The retainer portion 24D also includes an aperture 38D for receiving a doubled-over looped portion of the net 14. The net is retained on the clip 16D by causing the doubled-over looped portion 15 to pass through the aperture 38D and extend around the retainer portion 24D of the clip 16D, as illustrated in FIGS. 23–25. Thus, upon application of a predetermined force to the net 14, the net 14 will be rigidly retained on the clip 16D and will cause the clip 16D to detach from an associated stud 18.

Figure 26:
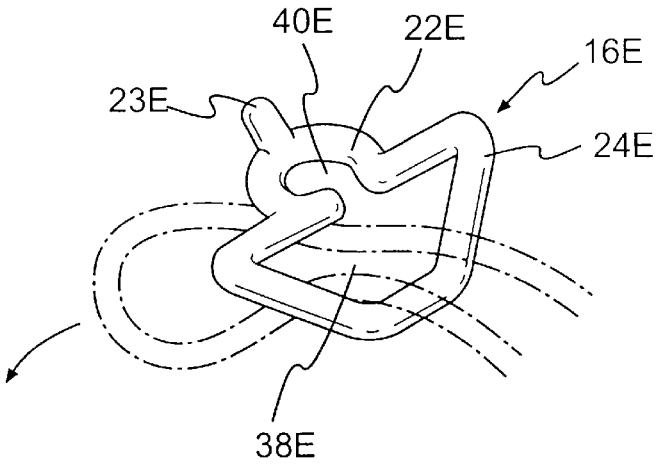
FIGS. 26–28 are perspective views of a seventh embodiment of the clip showing the steps of attaching a portion of the net to the clip.
Figure 27:
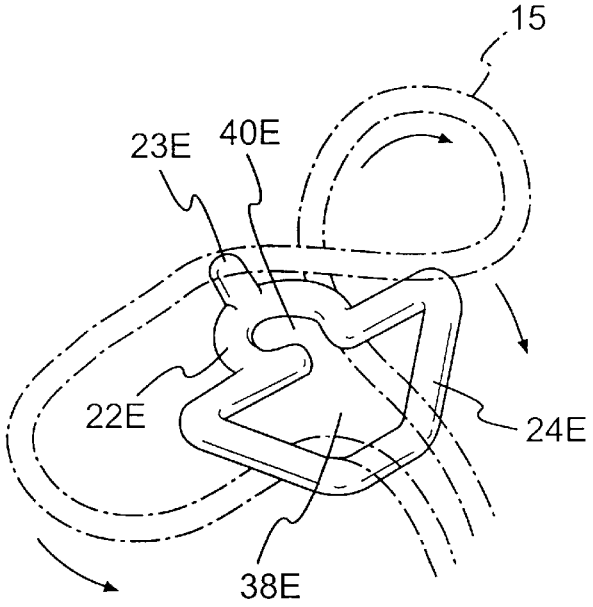
Figure 28:
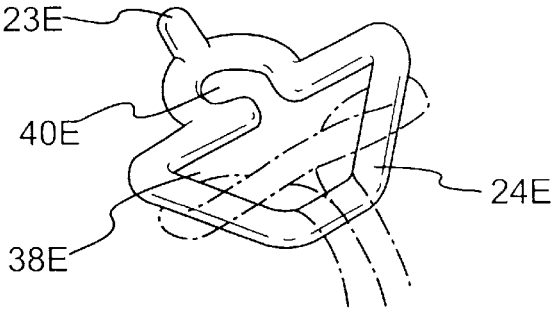

Referring to FIGS. 26–28, a seventh embodiment of the clip is illustrated designated as 16E. The clip 16E includes a base portion 22E and a retainer portion 24E. The clip 16E is formed as a substantially hollow frame member wherein the base 22E is substantially circular defining a retainer portion aperture 40E for engaging a stud 18. Thus, the aperture 40E is defined by a loop of material forming the frame member and is adapted to resiliently open to permit passage of the head 20 for the stud 18 therethrough. The base 22E also includes an outwardly extending leg 23E to provide an additional support for contacting the rim 12 and stabilizing the clip 16E. Further, the retainer portion 24E defines an aperture 38E for receiving a doubled-over looped portion 15 of the net 14. The net 14 is attached to the clip 16E in a manner similar to that described above for the sixth embodiment of the clip 16D, as illustrated in FIGS. 26–28.

FIGS. 29–51 show various further embodiments of net retention systems of the invention in which the net clip is detachably connected to a rim in a different manner from the embodiments described so far. In FIGS. 29–51, the illustrated net clips have various types of projections, preferably integrally formed with the net clip, which are adapted to be engaged resiliently within one or more apertures in the rim. Only aspects of these embodiments that differ substantially from those previously described are discussed in detail below.

Figure 29:
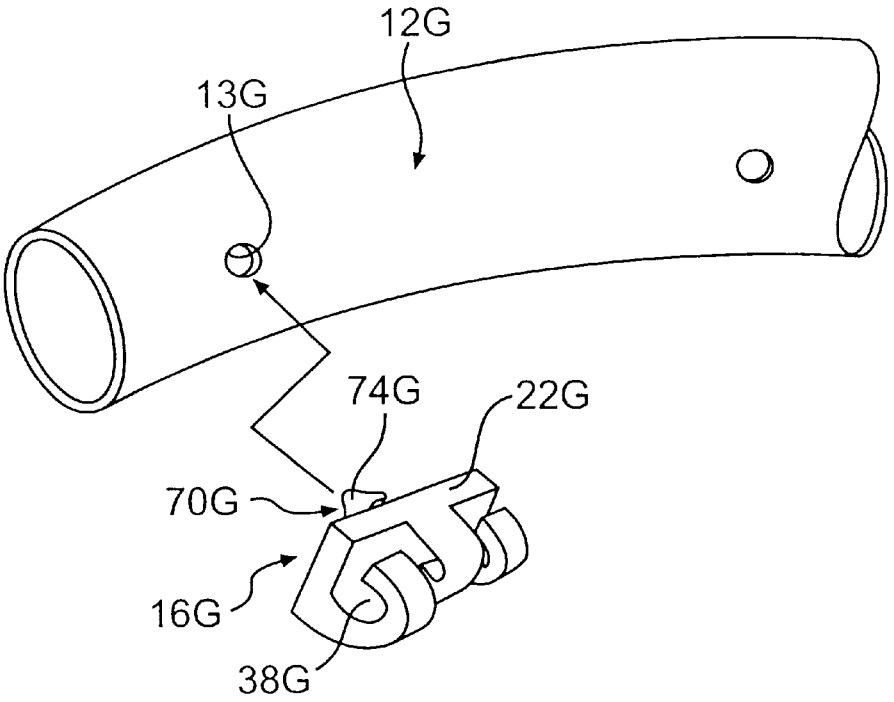
FIGS. 29–51 show various further embodiments of net retention systems of the invention in which the clip is provided with a projection resiliently engaged within an aperture in the rim.
Figure 30:
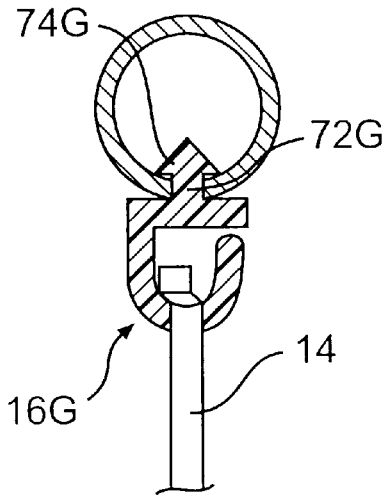

FIGS. 29-30 show an eighth embodiment of a clip 16G having a projection 70G, preferably integrally formed with the clip, which has a base portion 22G and a retainer portion defined by a plurality of resilient finger members that yield without breaking or permanently deforming to release the net. The base portion 22G may be curved to match the curved profile of the rim as with the previously described embodiments. In addition, while FIGS. 29-30 schematically show a clip similar to that illustrated in FIGS. 2–7, it will be appreciated that any of the finger-type release mechanisms described herein may be employed in this embodiment. The projection 70G includes a shaft portion 72G, preferably having a length substantially equal to or less than the thickness of the rim. The proximate end of the shaft portion 72G is connected to base 22G and the distal end includes an enlarged head portion 74G, preferably integrally formed therewith. Head portion 74G may be generally triangular in shape as shown to facilitate insertion into a smaller, circular opening 13G provided in the rim 12, which preferably is formed as a hollow goal ring. After insertion, the underside of resilient head portion 74G lies adjacent the interior surface of the rim near the opening 13G. Thus, after the clip 16G is snapped into place, it remains attached to the rim. Clip 16G may be designed to have a dual release mechanism permitting the net to release from the fingers and the clip to detach from the rim, or the triangular shape of enlarged head portion may be designed to prevent clip 16G from being removed from the rim after the projection 70G is inserted in opening 13G. In either event, the net is looped into the passage 38G formed by the finger members before or after the clip is snapped into place, and is releasable after application of a predetermined force on the net similar to the releasable finger embodiments described above.

Figure 31:
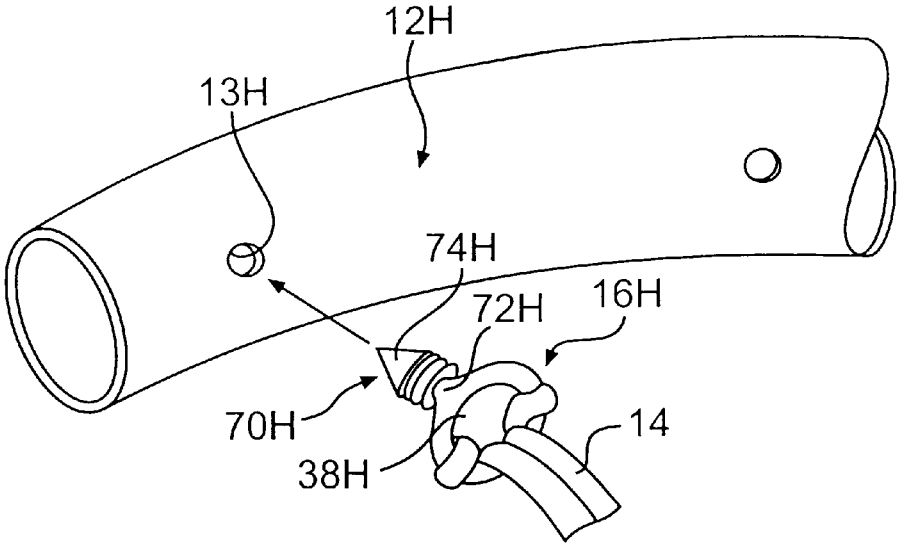
Figure 32:
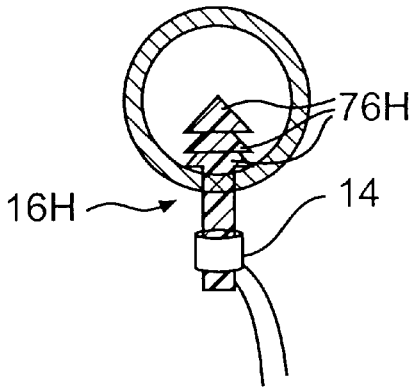

FIGS. 31-32 show a ninth embodiment of the invention that includes a clip 16H, which functions similarly to the sixth and seventh embodiments described in FIGS. 23–28 in which a doubled-over looped portion of the net is retained to on a clip, which is then detachably connected to the rim. Clip 16H is formed as an eyelet having a central opening forming a passageway 38H in which the doubled-over looped portion of the net is received and retained as described above. The eyelet has a projection 70H preferably integrally formed therewith, having a shaft portion 72H and an enlarged head portion 74H. As opposed to being formed as a single, triangular shaped member, head portion 74H may be formed as a series of flexible serrations 76H extending along the shaft. The serrations permit the clip 16H to be retained on the rim 12H within the aperture 13H until application of a predetermined force on the net, which permits the clip to release from the rim while the net remains attached to the clip in the same manner described above in connection with detachable clip embodiments of FIGS. 23–28.

Figure 33:
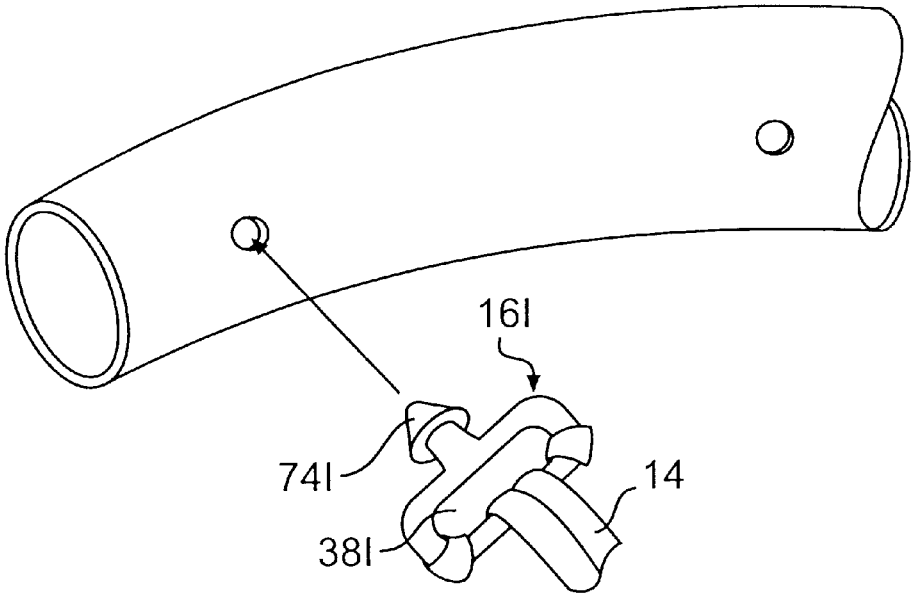
Figure 34:
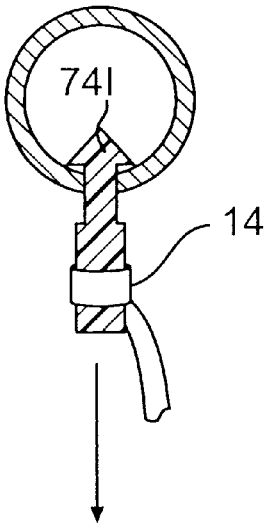

FIGS. 33-34 illustrate a tenth embodiment of a clip 16I that is substantially similar to the ninth embodiment of FIGS. 31-32. However, clip 16I has a single enlarged head portion 74I, similar to that shown in FIGS. 29-30, but which is designed to be detachable from the rim 12I upon application of a predetermined force on the net. This is accomplished by use of a larger diameter opening for aperture 13I and/or by use of a more flexible material for the head 74I. In addition, the clip 16I has an elongated shaped central opening 38I, as opposed to the circular one illustrated in FIG. 31.

Figure 35:
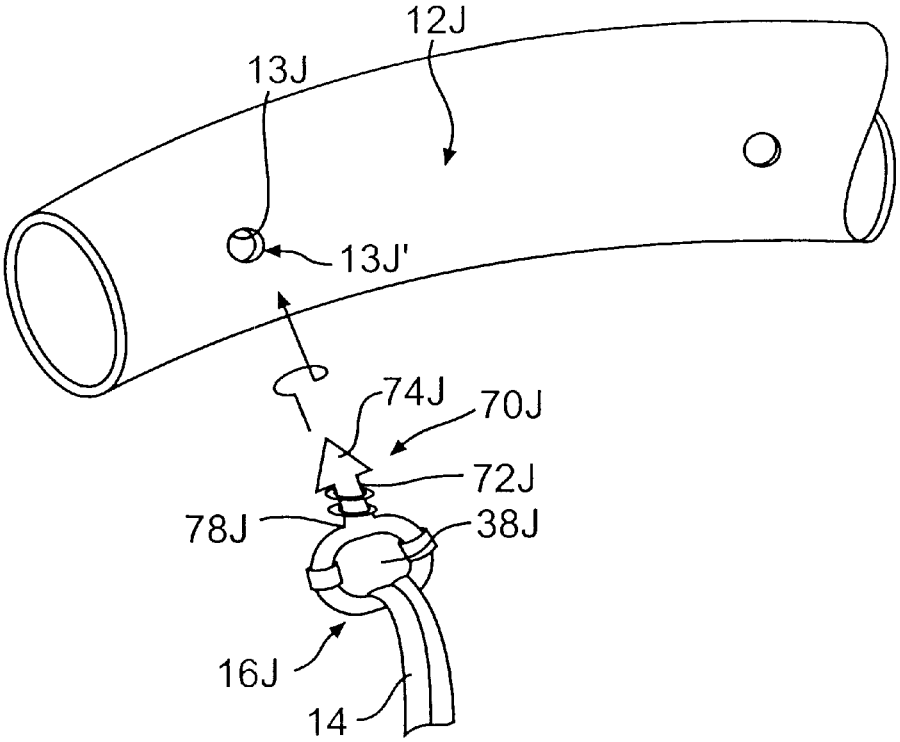
Figure 36:
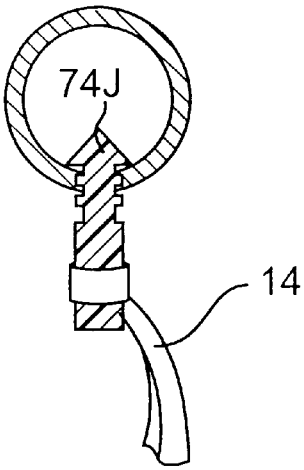

The eleventh embodiment of a clip 16J shown in FIGS. 35-36 is substantially similar to the ninth embodiment of FIGS. 31-32. However, clip 16J must be rotated to detachably connect it within an aperture 13J, which is formed as a "tanged" hole having a depressed section 13J'. The shaft portion 72J of projection 70J is formed with threads 78J, which facilitate rotation of clip 16J, e.g., ¼ of a revolution, to engage head portion 74J behind the inner portion of the rim adjacent hole 13J. The rotation of clip 16J allows depressed section 13j' of hole 13J to engage thread 78J. Thus, enlarged head portion 74J must be forced through a narrow portion of hole 13J to release the clip 16J and net 14 from the rim. Thread 78J is preferably made from a resilient material that deforms sufficiently to allow the clip 16J and net 14 to release from the rim.

Figure 37:
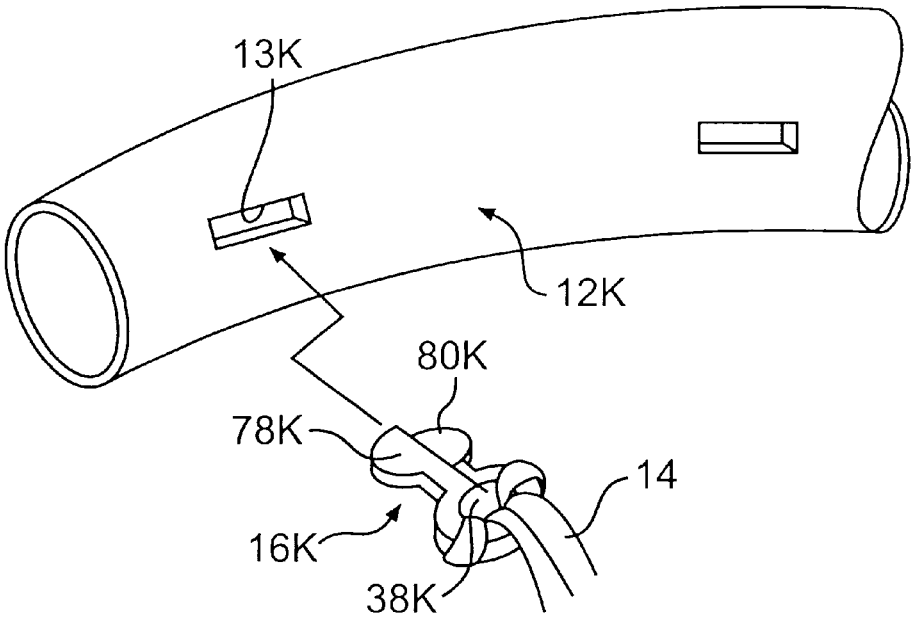
Figure 38:
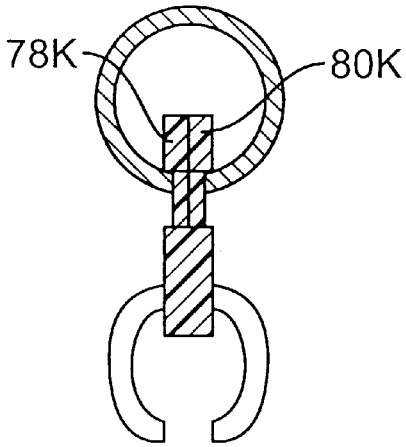

The twelfth through fourteenth embodiments of the invention illustrated in FIGS. 37-38, 39-40, and 41-42, respectively, show various net clips similar to the eyelet-type embodiments described above. However, in these embodiments the rim retaining projection of the clip is formed as a pair of scissor-like legs, which are detachably retained in a aperture in the rim formed as a generally elongated slot. In FIGS. 37-38, clip 16K has a pair of opposed, resilient legs 78K, 80K will bulbous end portions extending, preferably integrally, from the eyelet portion of the clip forming central passageway 38K. As shown best in FIG. 38, legs 78K, 80K are disposed in adjacent planes, which permit them when flexed inwardly to lie one over the other in a scissor-like fashion. Thus, after the net is tied off onto the clip (by inserting a doubled-over looped portion through the passageway 38K and around the clip 16K as in the other detachable clip embodiments described above), the legs 78K, 80K are pushed together such that their lateral dimension is reduced enabling the bulbous end portions to pass through slot 13K as the clip is inserted therein. The legs 78K, 80K then spring open again due to their inherent resiliency when pushed past the slot 13K. The bulbous end portions retain the clip on the rim until application of a predetermined force on the net, which forces the legs together as the clip is pulled through the slot to permit the clip to be detached from the rim.

Figure 39:
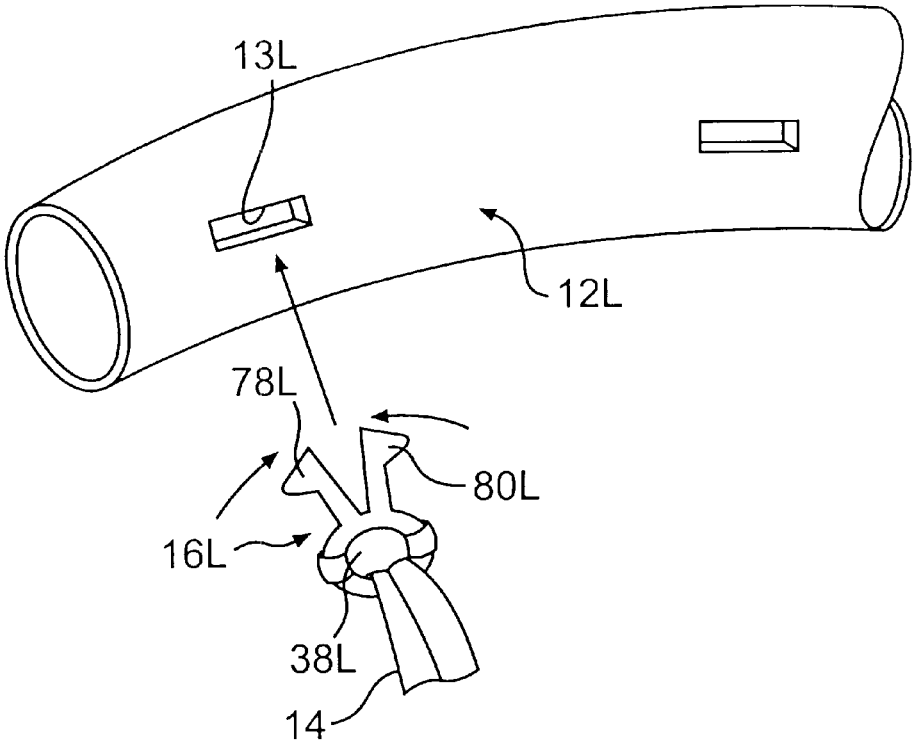
Figure 40:
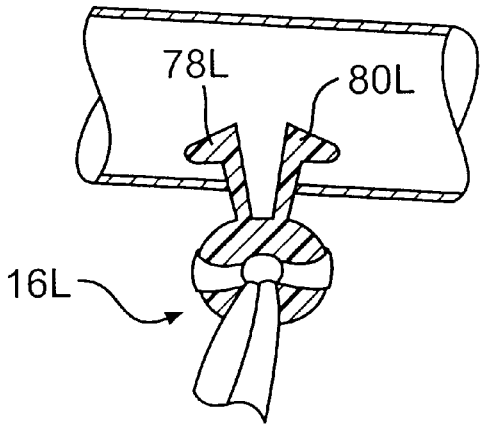
Figure 41:
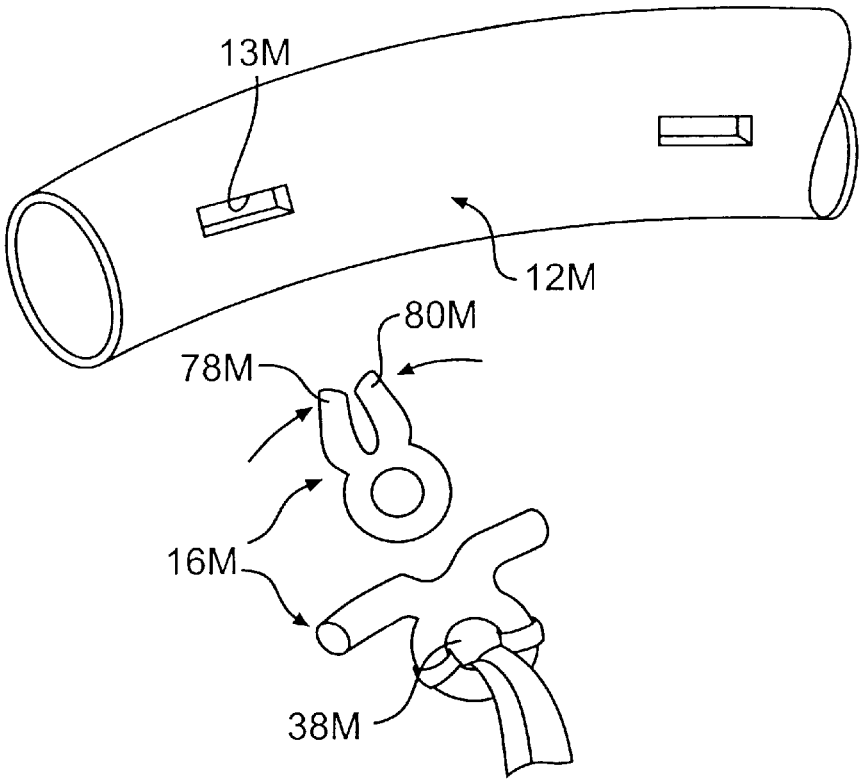
Figure 42:
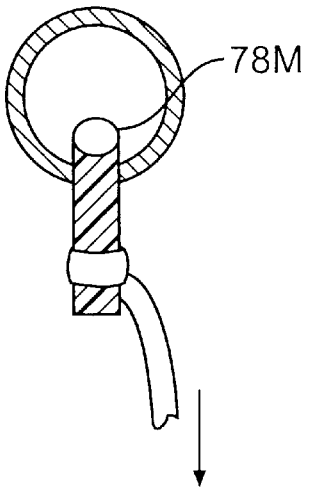

The thirteenth embodiment of the invention includes a clip 16L shown in FIGS. 39-40, which is substantially similar to the twelfth embodiment described in FIGS. 37-38, but the scissor-like legs 78L, 80L are disposed in the same plane and the bulbous end portions of the legs are shaped somewhat differently as generally triangular members. However, clip 16L functions substantially similarly to clip 16K, as does the fourteenth embodiment shown in FIGS. 41-42. In the fourteenth embodiment, clip 16M also has scissor-like legs 78M, 80M in the same plane, but the legs are formed as long, bar-type members normally spaced apart from each other. This embodiment obviates the need for bulbous end portions for detachably retaining the clip within the rim.

Figure 43:
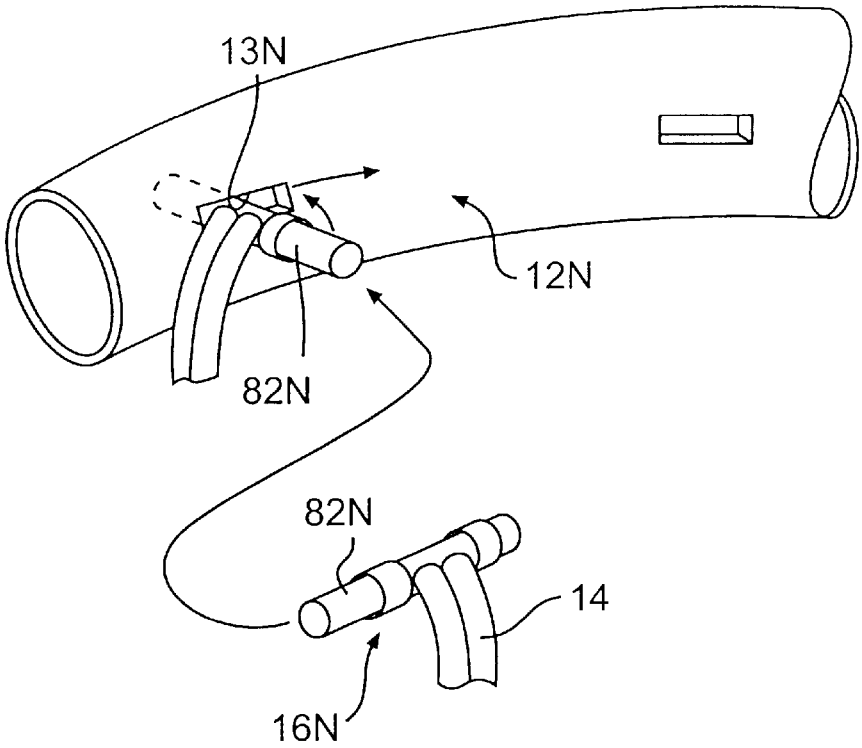
Figure 44:
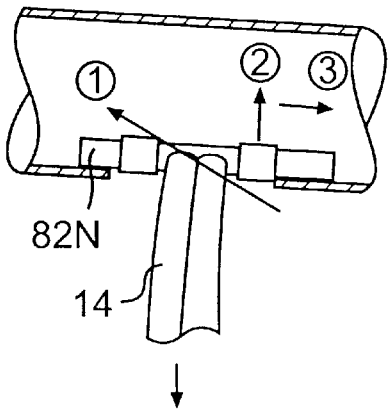

The fifteenth embodiment of the invention shown in FIGS. 43-44 illustrates a clip 16N formed as a single, resilient rod-like member 82N. Clip 16N includes a central aperture through which the doubled-over looped portion of the net is received. After the net is tied off in the manner discussed above, the clip 16N is inserted one end at a time into the elongated slot 13N. As the length of the rod 82N is longer than the length of the slot 13N, the rod must be forced into the slot by bending. Once both ends are received on the inside surface of the rim, the rod is centered and the clip is retained on the rim. Upon application of a predetermined force on the net, rod 82N flexes as it passes through the slot 13N to release the clip 16N and its attached portion of the net from the rim.

Figure 45:
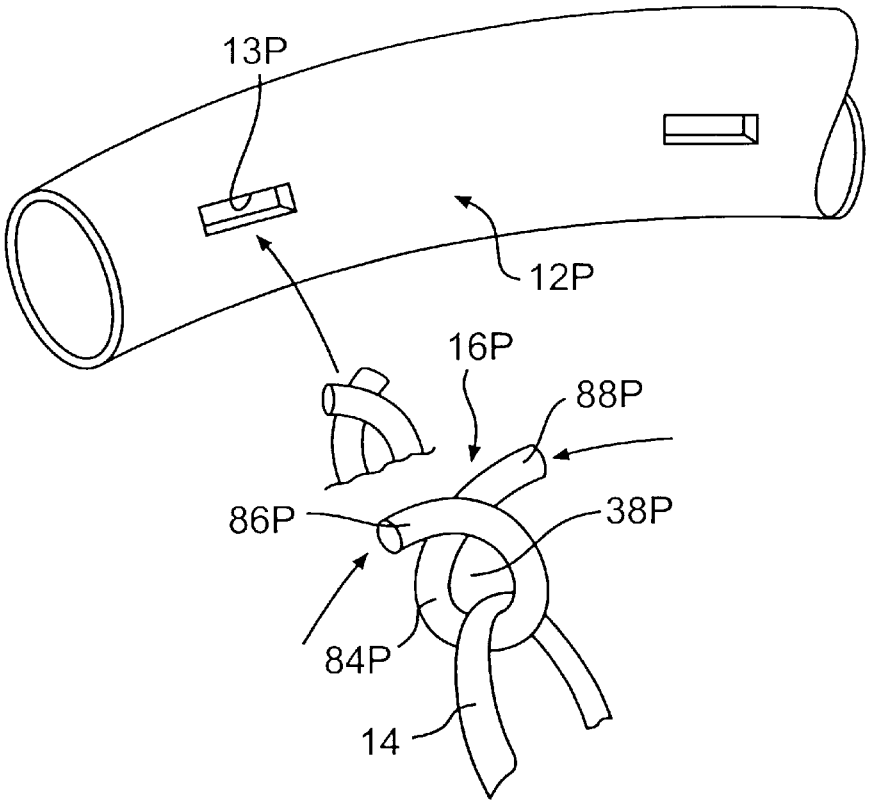
Figure 46:
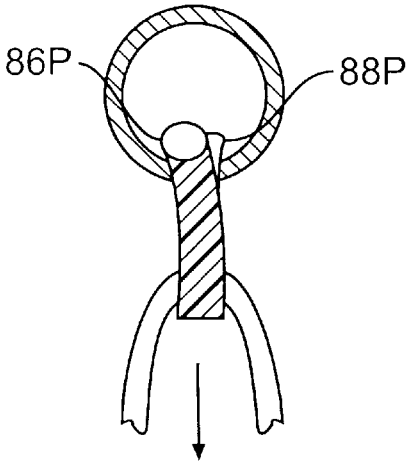

The sixteenth embodiment of the invention shown in FIGS. 45-46 is similar to the fifteenth embodiment as the clip 16P also is formed from a single, flexible rod-like member 84P. However, in this embodiment, the rod 84P is twisted such that the middle of the rod forms the central passageway 38P through which a portion of a net may be received. The ends 86P, 88P of the twisted member abut against each other to close the passageway 38P and point in opposite directions as shown in FIG. 45. In this embodiment, a looped portion of the net is forced past the abutting ends 86P, 88P of the twisted clip and is received within passageway 38P. Thus, there is no need to thread a doubled-over looped portion of the net through the passageway and around the net as in the other embodiments in which the net and clip remain attached during release of the clip from the rim. The clip 16P may be inserted into the slot 13P after the ends 86P, 88P are squeezed together to permit the clip to pass through the slot 13P. Once through the slot, the ends 86P, 88P retain the clip on the rim in a manner similar to the scissor-type clip embodiments discussed above, such as that disclosed in FIGS. 41-42. Ends 86P and 88P are squeezed together after application of a force to net 14 which forces the clip to be pulled through slot 13P and detach from the rim.

Figure 47:
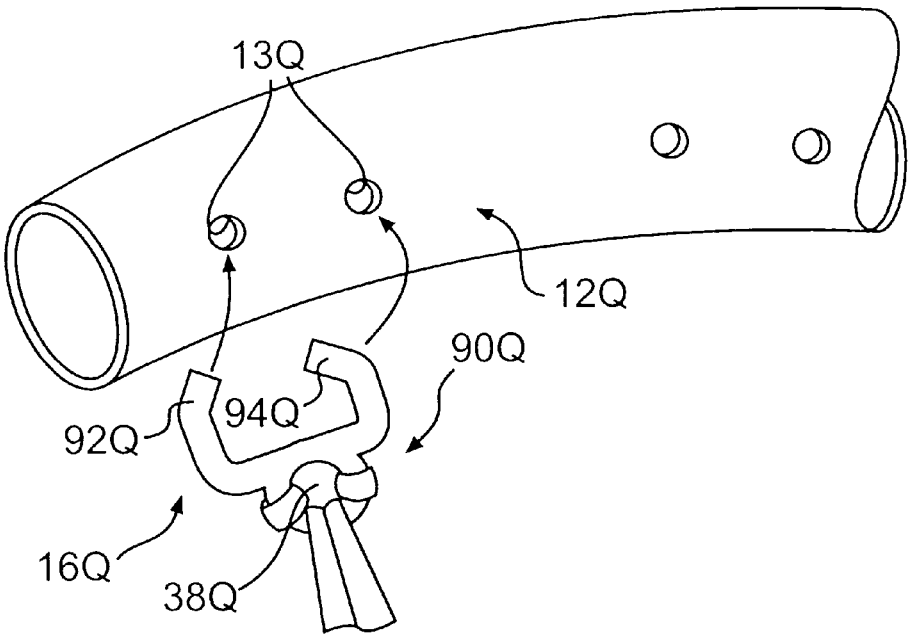
Figure 48:
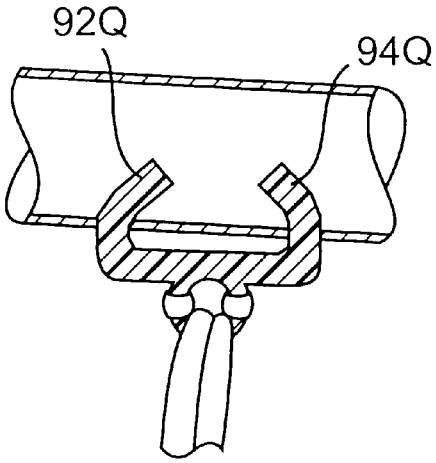

The seventeenth embodiment of the invention illustrated in FIGS. 47-48 is similar to the eyelet clip embodiments discussed above in that the clip 16Q has an eyelet portion defining a central passageway therethrough receiving a doubled-over looped portion of a net. However, instead of having an elongated projection extending from the eyelet portion, clip 16Q includes a generally "U-shaped portion" 90Q having resilient legs with bent ends 92Q, 94Q, which are adapted to be received in a pair of spaced, circular openings 13Q. After the doubled-over looped portion of the net is tied onto the clip in the manner described herein, one end 92Q is inserted into one of the apertures 13Q, and then the other leg 94Q is pulled and forced into the other of the apertures 13Q. The bent ends 92Q, 94Q retain the clip 16Q on the rim until application of a predetermined force on the net that straightens the ends and permits the clip to be detached from the rim. Although the ends 920, 94Q and rim apertures 13Q are shown as being circular in cross section other matching shapes may be employed, as well.

Figure 49:
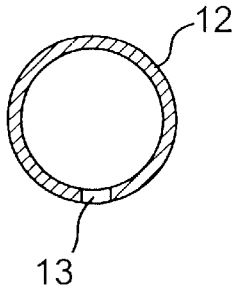
Figure 50:
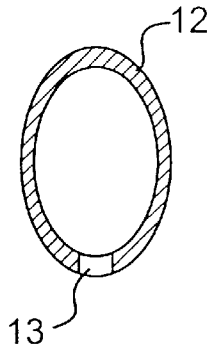
Figure 51:
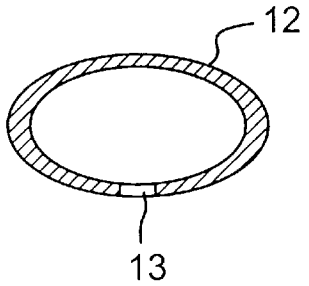
Figure 52:
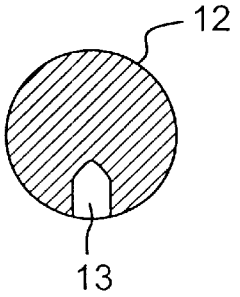

The eighth through seventeenth embodiments all require use of rim having small openings for receiving and retaining the net clips. FIGS. 49–52 show the presently preferred cross sectional shapes for the rim, although any shape that provides suitable strength and rigidity, while being compatible with the objects of a basketball game may be employed. FIG. 49 shows a classic hollow circular cross section, FIGS. 50-51 show generally oval shapes rotated 90 degrees from each other and FIG. 52 shows a solid circular cross section. In the oval embodiments, the mounting apertures 13 may be parallel to the major axis of the oval as shown in FIG. 50 or parallel to the minor axis of the oval as shown in FIG. 51.

Figure 53:
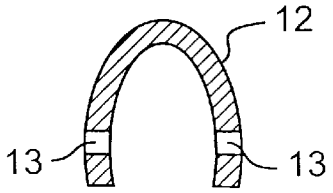

One particularly advantageous method to make rims suitable for these embodiments involves forming hollow goal rings from tubular stock of steel, plastic or other suitable material (typically, ⅝" or ¾' diameter for circular rims, 1"×2" for oval shaped rims) that is punched, stamped or otherwise subjected to a forming operation that places the desired number of holes in a predetermined pattern in the tube. A solid goal ring made from steel, plastic or other suitable material may also be used. Alternatively, the goal ring 12 can also be in the form of a "U"-shaped channel as shown in FIG. 53 with apertures 13 located in the sides of the rim which are adapted for receiving a net clip.

The number of holes is determined by the number of loops and clips designed to retain the net. Typically, regulation size nets have 12 loops, which would require 12 net clips of the invention, and 12 equally spaced sets of one or two apertures each, depending upon the particular net clip embodiment employed. While the rim apertures are generally shown as circular holes or elongated slots, other forms and shapes such as keyhole slots may be used. After the tubular material is provided with the desired number of apertures, the goal tube is then formed into a ring and placed in a fixture so that support arms and brackets may be attached in any conventional fashion such as welding or the like. Alternatively, the goal may be made from a sheet of material that is subjected to an aperture forming operation such as punching, stamping, etc., prior to rolling into a tube, and then forming into a ring. Additionally, mounting studs of the type described in connection with the first seven embodiments may be provided on the hollow goal ring and corresponding apertures would be then provided on the net clips.

In addition to forming the clips of the invention from resilient plastic materials like nylon, polypropylene, or similar materials, it may be possible to use steel, particularly spring steel to make some of the clips of the invention. In particular, the straight and twisted bar embodiments of FIGS. 43–46 are particularly well suited for steel clips, as long as they are designed to have sufficient strength and flexibility to deform elastically without breaking or permanently deforming.

From the above description, it should be apparent that the breakaway net attachment system of the invention is adapted to retain a net on a basketball goal rim in a manner which ensures that the net remains in place during normal play and which permits the net to be detached from the rim in response to the application of a predetermined force. In addition, it should be noted that the present system is particularly designed to permit a net to become detached upon the application of a force in the range of 25–50 lbs., when such force is applied to a single clip. Further, the system is adapted to release a net from a basketball goal rim when a force of 140 lbs. is applied to a net supported by a typical system incorporating twelve clips mounted to the rim.

It should also be apparent that the invention is designed to ensure that the clips for mounting the net are not lost when the net becomes detached in that the clips are designed to either remain attached to the rim or attached to a portion of the net upon detachment of the net from the rim, such that the system facilitates reattachment of the net to the rim.

Further, the attachment system of the invention provides a non-obtrusive means for attaching a net to a basketball goal rim in that the clips provided by the invention are substantially located below the rim. In this manner, the possibility of contact between the clips and a basketball is minimized.

While the forms of apparatus and processes herein described constitute preferred embodiments of this invention, it is to be understood that the invention is not limited to these precise forms, and that changes may be made therein without departing from the scope of the invention which is defined in the appended claims:

What is claimed is:

1. A system for detachably retaining a net on a basketball goal rim, said system comprising:

(a) a net clip having a portion configured to retain a section of the net;

(b) a mounting projection, said projection attached to one of the net clip and the rim;

(c) a mounting aperture, said aperture provided on the other of the net clip and the rim, said mounting projection and said mounting aperture being engageable to connect the clip to the rim; and (d) a net release mechanism including a flexible portion, said flexible portion being resilient enough to yield without breaking or permanently deforming to release the net from the rim in response to application of a first predetermined force on the net.

2. The system of claim 1, wherein said flexible portion of the net release mechanism comprises at least one elongated finger member of the net clip at least in part defining a passage for retaining the section of the net.

3. The system of claim 1, wherein said net release mechanism further comprises a disengageable connection between said mounting projection and said mounting aperture, with said flexible portion of said net release mechanism comprising a portion of one of said mounting projection and said mounting aperture.

4. The system of claim 3, wherein the net section comprises a doubled-over-looped portion of the net and application of said first predetermined force increases the magnitude of force that retains the doubled-over-looped portion on the net clip such that the doubled-over-looped portion of the net remains attached to the clip when said mounting projection separates from said mounting aperture.

5. The system of claim 1, wherein said flexible portion of said net release mechanism comprises a first net release mechanism, and said mounting projection and said mounting aperture are disengageable to define a second net release mechanism, said second net release mechanism being operable in response to application of a second predetermined force on the net greater than said first predetermined force wherein said net clip remains connected to the rim upon application of a force on the net having a magnitude less than the second predetermined force.

6. The system of claim 1, wherein said mounting projection is provided on the net clip and said mounting aperture is provided on the rim.

7. The system of claim 6, wherein said mounting projection comprises a shaft having an enlarged portion at one end.

8. The system of claim 7, wherein said enlarged portion is formed of resilient material.

9. The system of claim 1, wherein said rim has a first curvature and said net clip includes a base portion having a second curvature substantially matching the first curvature.

10. The system of claim 1, wherein said net clip further comprises at least one projection configured to prevent rocking or rotational movement of the clip relative to the rim.

11. Basketball apparatus comprising:

(a) a basketball goal rim including a plurality of mounting apertures;

(b) a plurity of net clip, each net clip including a mounting member engageable with one of siad mounting apertures to connect the clip to the rim, each net clip further including a retainer configured to hold a section of a basketball net on the rim; and (d) a net release mechanism including a flexible portion operable to release the net from one of said retainer and said rim without breaking or permanently deforming the clip upon application of a first predetermined force on the net.

12. The basketball apparatus of claim 11, wherein siad first predetermined force is operable to disengage said mounting member from said mounting aperture to detach the net clip from the rim while retaing the net clip and net section together.

13. The basketball apparatus of claim 12, wherein said retainer comprises a second net release mechanism configured to releasably engage the net such that the net is disengaged from said net clip upon application of a second predetermined force, said second predetermined force being less than said first predetermined force.

14. The basketball apparatus of claim 13, wherein said second net release mechanism comprises at least one elongated finger defining at least in part a passageway for receiving said net section, said elongated finger being formed from a resilient material.

15. The basketball apparatus of claim 11, wherein said mounting member is formed from a resilient material.

16. The basketball apparatus of claim 11 wherein said mounting member further comprises an elongated projection on said net clip.

17. The basketball apparatus of claim 11 wherein said mounting member further comprises an elongated projection with an enlarged head on said net clip.

18. The basketball apparatus of claim 11 wherein said mounting member further comprises an elongated projection with serrations on said net clip.

19. The basketball apparatus of claim 11 wherein said mounting member further comprises a pair of compressible, scissor-like members.

20. The basketball apparatus of claim 11 wherein said mounting member further comprises a rod-like member.

21. The basketball apparatus of claim 11 wherein said mounting member further comprises a twisted rod-like member having compressible ends, said ends abutting to define in part said passage.

22. The basketball apparatus of claim 11 wherein said mounting member further comprises a pair of spaced elongation projections.

23. A method of detaching a net from a basketball goal rim comprising the steps of:

(a) providing a basketball goal rim having first mounting portions;

(b) providing net attachment clips each comprising second mounting portions configured to releasably engage said first mounting portions, said net attachment clips each further comprising a net retainer for retaining a portion of the net;

(c) attaching the net attachment clips to the rim;

(d) disposing portions of the net onto the net attachment clips by disposing said portions within said net retainers; and (e) applying a first predetermined force to the net to detach the net from the rim without breaking or permanently deforming the net attachment clips.

24. The method of claim 23 wherein said release mechanism includes at least one resilient finger and the step of applying a first predetermined force comprises deflecting said finger without breaking or permanently deforming said finger.

25. The method of claim 23 wherein:

said first mounting portions comprise apertures within said rim;

said second mounting portions comprise insertion members; and said step of attaching the net attachment clips to the rim comprises inserting said insertion members into said apertures.

26. The method of claim 23 wherein said net retainers are capable of releasing said portions of the net from the net attachment clips without breaking or permanently deforming the net attachment clips upon application of a second predetermined force that is less than said first predetermined force.

27. A basketball net clip comprising:

(a) a flexible insertion member formed from a resilient material for releasably inserting at least a portion of the net clip into an aperture in a basketball rim, said insertion member operating to detach the net clip from said aperture upon application of a first predetermined force upon a basketball net; and (b) a net retainer having a passage configured to hold a section of the basketball net on the clip.

28. The net clip of claim 27, wherein said net retainer comprises at least one flexible elongated finger member defining at least in part said passage.

29. The net clip of claim 28, wherein said elongated finger member releasably retains a portion of the net, said elongated finger member operating to release said portion upon application of a second predetermined force that is less than said first predetermined force.

30. The net clip of claim 27, wherein said insertion member comprises an elongated projection.

31. The net clip of claim 30 wherein said elongated projection further comprises flexible serrations.

32. The net clip of claim 30 wherein said elongated projection further comprises an enlarged head.

33. The net clip of claim 30 wherein said elongated projection further comprises a pair of compressible, scissor-like members.

34. The net clip of claim 33 wherein the scissor-like members are in different planes.

35. The net clip of claim 33 wherein the scissor-like members are in substantially the same plane.

36. The net clip of claim 27 wherein the net clip comprises a rod-like member having an aperture therethrough.

37. The net clip of claim 27 wherein the net clip comprises a twisted rod-like member having compressible ends, said ends abutting to define in part said passage.

38. The net clip of claim 27 wherein the net clip comprises a pair of spaced elongation projections.

39. A breakaway net attachment system comprising:

(a) a basketball goal rim, said rim comprising a plurality of net clip attaching means; and (b) a plurality of resilient net clips each including net attaching means for receiving and retaining a portion of a basketball net and mounting means for releasably mounting the clip on the rim, said mounting means engaging said net clip attaching means to mount the clips to the rim.

40. The breakaway net attachment system of claim 39 wherein said net attaching means comprises a net releasing means for releasing the net from the clip upon application of a predetermined force to the net.

41. The breakaway net attachment system of claim 39 wherein said net clip attaching means comprises apertures in the rim for receiving said mounting means.

42. The breakaway net attachment system of claim 41 wherein said mounting means comprises at least one elongated member, and wherein the clip is mounted to the rim by inserting at least a portion of said elongated member into said aperture.

43. The breakaway net attachment system of claim 42 wherein said elongated member further comprises an enlarged head portion.

44. The breakaway net attachment system of claim 42 wherein said elongated member further comprises serrations.

45. The breakaway net attachment system of claim 42 wherein said mounting means is received by said aperture by being screwed into said aperture.

46. The breakaway net attachment system of claim 42 wherein said at least one elongated member further comprises a pair of compressible, scissor-like members.

47. The breakaway net attachment system of claim 46 wherein the scissor-like members are in different planes.

48. The breakaway net attachment system of claim 46 wherein the scissor-like members are in substantially the same plane.

49. The breakaway net attachment system of claim 42 wherein the elongated member comprises a rod-like member having an aperture therethrough.

50. The breakaway net attachment system of claim 42 wherein the elongated member comprises a twisted rod-like member having compressible ends.

51. The breakaway net attachment system of claim 42 wherein the elongated member comprises a pair of spaced elongation projections.

* * * * *